US007395691B2

(12) United States Patent
Sterner et al.

(10) Patent No.: US 7,395,691 B2
(45) Date of Patent: Jul. 8, 2008

(54) METHOD AND APPARATUS FOR DETERMINING GAS CONTENT OF SUBSURFACE FLUIDS FOR OIL AND GAS EXPLORATION

(75) Inventors: Steven Michael Sterner, Tulsa, OK (US); Donald Lewis Hall, Tulsa, OK (US); Wells Shentwu, Broken Arrow, OK (US)

(73) Assignee: Fluid Inclusion Technologies, Inc., Broken Arrow, OK (US)

( * ) Notice: Subject to any disclaimer, the term of this patent is extended or adjusted under 35 U.S.C. 154(b) by 0 days.

(21) Appl. No.: 11/726,009

(22) Filed: Mar. 20, 2007

(65) Prior Publication Data

US 2007/0169540 A1 Jul. 26, 2007

Related U.S. Application Data

(62) Division of application No. 10/158,990, filed on May 31, 2002, now Pat. No. 7,210,342.

(60) Provisional application No. 60/295,452, filed on Jun. 2, 2001.

(51) Int. Cl.
*E21B 49/08* (2006.01)

(52) U.S. Cl. ..... 73/19.09; 73/152.04; 73/152.18; 73/152.19; 73/152.23

(58) Field of Classification Search ..... 73/19.09, 73/23.37, 152.04, 152.18, 152.19, 152.23
See application file for complete search history.

(56) References Cited

U.S. PATENT DOCUMENTS

| | | | | |
|---|---|---|---|---|
| 5,277,263 | A * | 1/1994 | Amen | 175/42 |
| 5,313,061 | A * | 5/1994 | Drew et al. | 250/281 |
| 5,328,849 | A * | 7/1994 | Smith | 436/32 |
| 5,525,799 | A * | 6/1996 | Andresen et al. | 250/288 |
| 6,351,983 | B1 * | 3/2002 | Haas et al. | 73/23.37 |

* cited by examiner

*Primary Examiner*—Daniel S Larkin
(74) *Attorney, Agent, or Firm*—Head, Johnson & Kachigian

(57) ABSTRACT

A process to analyze fluid entrained in well boreholes. The process includes gathering trap gas samples from return of drilling mud at multiple depths. The process also includes the steps of subjecting the samples to mass spectrometry in order to determine mass to charge ratios data of hydrocarbons and analyzing the mass to charge ratios data in relation to depth or time. Samples from at least one other source may also be gathered and analyzed chosen from the group consisting of mud fluid analysis, cuttings backgrounds analysis and cuttings crush analysis.

2 Claims, 25 Drawing Sheets

METHOD AND APPARATUS FOR DETERMINING GAS CONTENT OF SUBSURFACE FLUIDS FOR OIL AND GAS EXPLORATION

CROSS REFERENCE TO RELATED APPLICATIONS

This application is a divisional of U.S. patent application Ser. No. 10/158,990 filed May 31, 2002, now U.S. Pat. No. 7,210,342, which claims the benefit of U.S. Provisional Patent Application No. 60/295,452 filed Jun. 2, 2001, entitled "Method and Apparatus For Determining The Gas Content of Present and Past Subsurface Fluids For Oil and Gas Exploration", the disclosures of which are herein incorporated by reference.

BACKGROUND OF THE INVENTION

1. Field of the Invention

The present invention relates to an apparatus and method for real-time analysis of 1) trap gas, 2) mud fluid and/or 3) cuttings for gas content in conjunction with exploring the earth's subsurface for economic, producible hydrocarbons. In another aspect, the present invention relates to mapping the distribution, chemistry and relative and/or absolute abundance of chemical species analyzed by the above apparatus and method.

2. Prior Art.

Petroleum resources are the cumulative result of generation, expulsion, migration and trapping of petroleum in sedimentary basins. Petroleum fluids (both gas and liquid) are retained in the source rocks and along migration pathways as residual petroleum saturation in macro or micropores during movement of these fluids from source to reservoir. Microscopic amounts of migrating or reservoired petroleum fluids are trapped within source rocks, along migration pathways or within petroleum reservoirs within healed fractures or porosity-occluding cements (i.e., fluid inclusions). Leakage or remigration of petroleum-bearing reservoirs can result in retained, non-economic petroleum residue within macro or microporosity in the reservoir sections. Finally, a given pore fluid may be substantially replaced by a subsequent fluid (hydrocarbon or aqueous) leaving little evidence of the prior fluid's presence, with the exception of fluid inclusions that are protected from alteration or displacement because they are completely encapsulated in mineral matter. This latter situation might exist, for instance, when a prior charge of oil is displaced by a later gas charge, due to density differences. In addition to the organic-dominated fluids mentioned above, natural inorganic species, such as $CO_2$, He, Ar, $N_2$, $H_2S$, COS and $CS_2$ are indicative of processes operative in the subsurface that are important to locating, understanding and exploiting petroleum occurrences.

It is known to circulate and analyze drilling fluid. Drilling fluid is generally circulated down a drill string to the bottom of a well. The drilling fluid is recovered from the well via a mud return line.

Current well site mudlogging operations generally include a device that analyzes gases emanating from the mud system circulated through the borehole during drilling. Generally the apparatus consists of a combustible gas detector (also known as a total gas detector or hot-wire detector) and, also, a gas chromatograph (GC) that typically analyzes alkanes with 1 to 5 carbon atoms. The total gas detector provides a more-or-less continuous record, while the GC operates on a cycle of 3-6 minutes. The gases that are detected represent some combination of pore fluids released from the volume of rock comminuted by the drill bit, fluids invading the borehole from formations that are overpressured with respect to the mud column, fluids generated through thermal processes at the drill bit (e.g., some so-called shale gases) and fluids derived from materials added to the mud system for a variety of reasons. Henceforth, these fluids are called borehole volatiles, while loosely or tightly encapsulated fluids within rock material are henceforth called cuttings volatiles regardless of whether they are derived from drill cuttings or drill core.

The systematic and comprehensive analysis of borehole volatiles and cuttings volatiles can be used to evaluate where petroleum fluids are currently, where they have been in the past, the composition and quality of petroleum fluids and other information useful to the oil and gas industry and particularly to well drilling and completion operations. Current methods provide a very incomplete record of above-described subterranean fluid history recorded by borehole and cuttings volatiles, due to the industry-standard choice of instrumentation and methodology. Specifically, the so-called hot-wire or total-gas detector provides only a measure of the total amount of combustible hydrocarbons without any compound specificity. Analysis of a split of these gases with a GC provides a measure of methane, ethane, propane, n-butane and iso-butane. Higher paraffins may be measured, but are not commonly. Limitations of this analysis stem from the fact that these species are all of the same class of hydrocarbon compounds (paraffins), hence, tend to react similarly to subsurface processes. The other two dominant classes of hydrocarbon compounds, naphthenes and aromatics are not explicitly analyzed. The relative distribution of these compounds can vary by several orders of magnitude in response to source rock attributes, migration processes and phenomena operative in the reservoir. While it is true that dry gas can be distinguished from wet gas or oil with well site gas detection equipment, it is difficult to distinguish between wet gas, condensate and oil with current GC based instrumentation. Ratios of low molecular weight paraffins are used in attempts to distinguish oil from gas (e.g., wetness factors), but these are often inadequate for the task.

It is not possible with GC-based methods to distinguish compounds that exist as a free phase in the pore system from those that may be dissolved in an aqueous pore fluid since GC methods generally do not measure a wide range of carbon species. This limitation prevents, for instance, distinguishing petroliferous formations from underlying water legs or water-bearing formations that are charged up dip, based on concentrations of water-soluble compounds such as benzene and acetic acid. Currently fluid contacts are identified solely based on decreases in paraffin gas abundance. The methodology and apparatus recommended herein provides evidence for petroleum-water contacts based on decreases in relatively water-insoluble compounds and concomitant increases in relatively water-soluble compounds.

Another critical element is the speed at which compounds can be collected. Although hot wire analysis is more-or-less continuous, typical GC cycle times are on the order of 3-6 minutes. Under fast drilling rates, this can translate to a sample analysis every 5 feet or more. Hence, thinly bedded pay horizons may be missed, or only recorded by an increase in total gas. The mass spectrometry based technique of this invention allows continuous monitoring of the gas flow, and cycle times as fast as 15 seconds. Even at slower times (up to 6 minutes), monitoring is continuous, so that an increase in borehole gas will be recorded almost instantaneously over the remaining mass range that is being scanned. The scan rate can be selected from the computer interface and implemented more or less instantly to fit the drilling rates anticipated, another feature that is not possible with a GC without extensive instrument modification.

Current art teaches away from using mass spectrometry (MS) on wellsite because of a perceived lack of reliability due to rugged conditions encountered in the field. The present design has been demonstrated to be more reliable than current GC technology, and less prone to operator error.

Prior art methods for analysis of fluid inclusions from a plurality of rock samples and stratigraphically mapping these chemistries are known (e.g., U.S. Pat. No. 5,286,651), however, that methodology and apparatus has some critical limitations that are improved upon by the current invention. First, previous methods advocate use of multiple mass spectrometers, whereas the preferred embodiment of the present invention can acquire substantially similar information with one mass spectrometer. In addition to cost savings, this obviates the need for inter-mass spectrometer calibration, and prevents analytical artifacts introduced by the unavoidable differences in sensitivity, resolution and the like, among mass spectrometers. Second, prior art teaches the advantage of jump scanning from mass to mass, whereas the current invention has found that continuous scanning allows more accurate peak location and better analytical statistics. Third, multiple scans, and specifically a large number of scans are advocated by prior art, however, it has been learned that the advocated procedure of jump scanning coupled with fast scan rates to get an abundance of scans in the time frame required, produces poor mass resolution due to recovery limitations of the electronics and decreases overall sensitivity because of poor counting statistics. Using few scans, slower scan speeds and continuous scanning mode produces much better precision, resolution and sensitivity. Finally, prior art involves placing multiple samples contained within multiple sample chambers in the same vacuum system and sequentially crushing them allowing the evolved gases from one sample to contact the surfaces of previous samples as well as those not yet analyzed. This procedure has several disadvantages, including potential cross contamination of samples and/or volatiles, development of progressively higher backgrounds during analysis of large sample sets unless unrealistically long pump-down times are employed between each sample, and selective near-instantaneous adsorption of released volatiles onto the surfaces of all samples in the chamber, resulting in fractionated and muted responses. Additionally, trace residual natural organic compounds, if present on grain surfaces, are additively contributed to the background and can create a disproportionately high background, which affects the baseline sensitivity of the analysis. It is advocated in prior art that this surface contamination be removed as much as possible, using vacuum heating and/or solvent extraction procedures. The current invention demonstrates the value of analyzing these trace natural surface organic species before removal and/or crush analysis of the trapped fluids. The resulting information can be used with borehole fluid analysis to distinguish among current charge in reservoirs, breached reservoirs, heavy oil or tar occurrences near oil-water contacts and migration pathways that have never accumulated significant oil saturation.

Other prior art approaches of analysis of gas content may be seen in Crownover, U.S. Pat. No. 4,635,735, wherein spectrophotometers utilizing a light signal are used for gas analysis.

While attempts have been made to improve some aspects of well site hydrocarbon detection (e.g., Quantitative Fluorescence Technique (QFT), Quantitative Gas Analysis (QGA), membrane technology), there is currently no comprehensive apparatus for analyzing past and present pore fluids in the necessary detail. Much information on current pore fluids at a given depth is lost once the borehole is drilled past that depth; hence, a portable apparatus capable of operating in a well site environment and functional for analyzing these fluids in real time is required. Cuttings volatile analysis can be completed on archived samples, but the surface adsorbed portion of the signal, discussed above, as well as the real-time application to drilling and completion operations are lost.

For discussion purposes, real-time analysis refers to capability of analyzing samples shortly after they emanate from the well bore, generally within minutes to perhaps 1 hour.

In summary, the present invention relates to a method and apparatus for determining the composition of borehole volatiles and cuttings volatiles, which provide an adequate record of most of the natural volatile elements and compounds found in the subsurface, or added to the well bore by drilling personnel during drilling operations.

The invention also relates to compositional mapping of cuttings and borehole volatiles derived from the subsurface, and oil and gas exploration using the results of such analyses.

SUMMARY OF THE INVENTION

The present invention relates broadly to analysis of fluids emanating from a drilling well as well as loosely or tightly encapsulated fluids collected from the same interval.

According to one aspect of the invention, the composition of borehole and cuttings volatiles is determined for a plurality of samples, representing different penetrated depths in a well bore using mass spectroscopic (MS) analysis of these species. A series of rock samples or borehole fluids can be quickly and rapidly analyzed to produce mass spectra of mass-to-charge ratio (MCR) responses across a range of such values encompassing abundant and trace inorganic and organic elements and compounds in borehole volatiles or cuttings volatiles, which are useful for interpreting the earth's history.

According to a further aspect of the invention, a chemical log of fluid chemistry is produced for a given borehole, where this log is some combination of species detected in the gas trap, species extracted from the mud system directly and/or species produced from placing rock material within a vacuum chamber and analyzing both the background (adsorbed species) and crush-analysis of trapped volatiles (fluid inclusions). While characterization of any one of these fluid components using the methods outlined herein can produce useful data, combining data from two or more fluid components (mud volatiles, trap gas or cuttings volatiles) is a preferred embodiment of the technique.

According to a further aspect of the invention, the chemical log produced by analysis of cuttings and borehole volatiles is used to influence drilling, testing and well completion decisions, including the possibility of redirecting the well bore from non-productive or marginally productive portions of the subsurface toward economic hydrocarbon accumulations.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

It is desirable to have a record of mass to charge ratio (MCR) for a borehole volatiles and/or cuttings volatiles sample that reliably permits comparison of compounds represented by one or more MCR to one or more others.

According to one aspect of the invention, there is provided a mass spectrometry (MS) system for producing such a reliable record. The MS system is configured and controlled for scanning a range of MCR of interest during the period of release of volatiles from each rock sample in the case of cuttings volatiles, and from fluids evolved from borehole mud samples and/or trap gas in the case of borehole volatiles. The results of these scans are collected and processed, according to the method herein and are stored in a manner so it is possible to relate each analysis to the collection location within the subsurface. In the case of a borehole, the data are generally found to be most useful when arranged as a function of depth.

MS is preferred over other analytical techniques (e.g., GC or GC-MS) because the latter do not provide enough chemical information, are too slow to permit collection of the necessary data in real time, and/or do not have the baseline sensitivity to analyze the trace amounts of volatiles present as fluid inclusions in rock material.

Overview of the Apparatus

Figure 18:
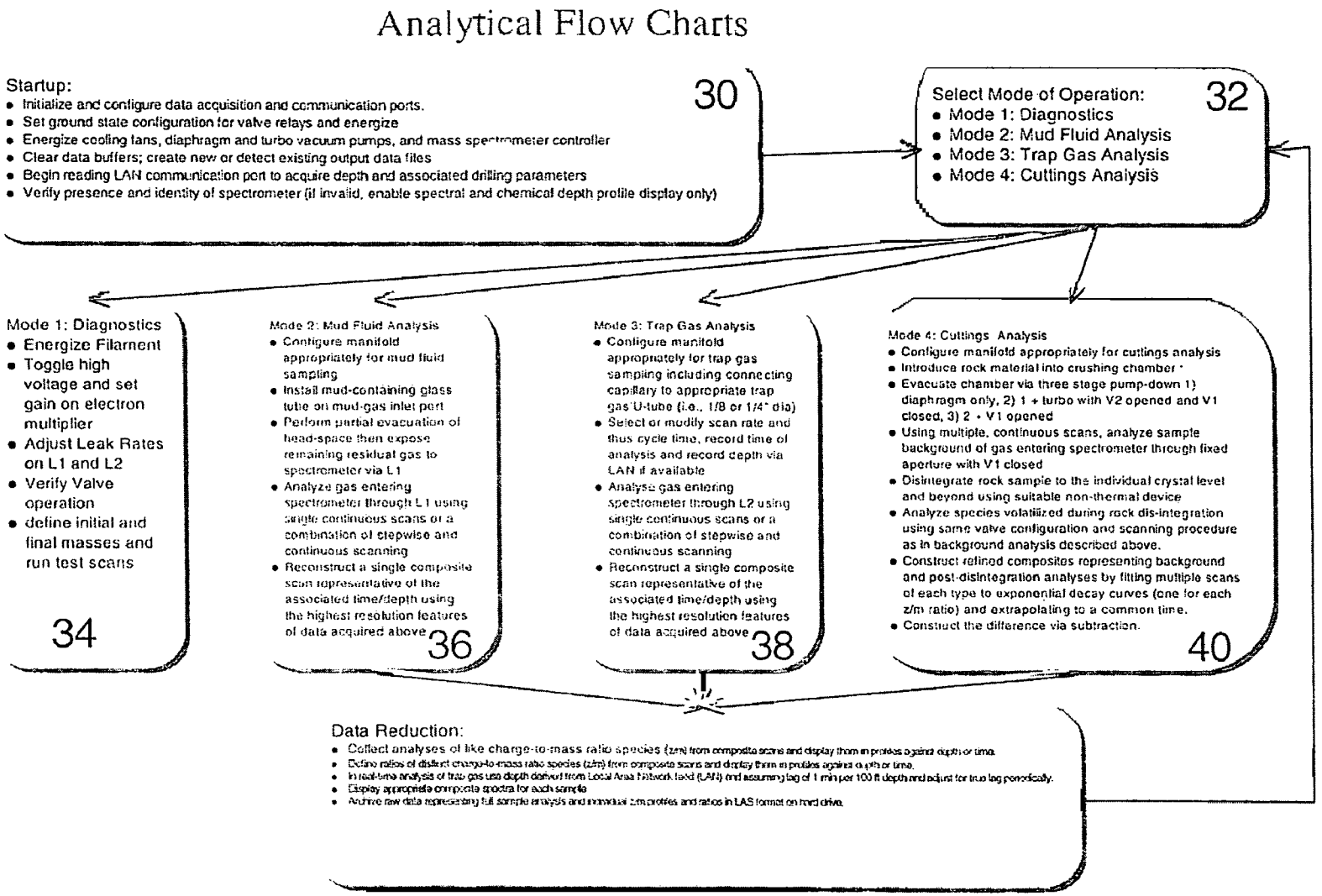
FIG. 18 is an analytical flow chart of processes and options of the present invention.

An apparatus is provided for routine, real-time analysis of three different types either singly or in any combination: 1) trap gas, 2) mud fluid, and/or 3) cuttings for organic and inorganic species and compounds that may be presented to an ionizer of a mass spectrometer via various sample inlet ports and associated apparatus described herein. A flow chart outlining the basic operation of the apparatus is provided in FIG. 18.

Initially, a set of procedures will be performed as set forth in box 30 labeled Startup. Thereafter, a mode of operation will be selected as set forth in box 32. Mode 1, seen in Box 34, pertains to diagnostics for the device. Three alternate modes of operation may be selected—mode 2 for mud fluid analysis shown in box 36, mode 3 for trap gas analysis shown in box 38, and mode 4 for cuttings analysis shown in box 40.

Mode 2 involves analysis of drilling mud fluid. Analysis of fluids dissolved or otherwise retained in the mud involves collecting a mud sample from the mud effluent, placing this mud in glass tube and attaching it to the inlet port of the instrument. Evacuation of the head space over the sample via the procedure outlined in a later section lowers the pressure over the mud and encourages even low vapor pressure species to volatilize into the head space overlying the mud. Additionally, atmospheric contamination is removed, which enhances detection of some species, as outlined above. Mud fluid analysis supplements trap gas analysis, the latter of which is more continuous and automated. Interpretation of the data from these two instrument modes is similar and is outlined in the examples section.

Mode 4 involves analysis of cuttings from the drilling. Cuttings gas analysis has historically been accomplished by sampling cuttings at the shale shaker which separates solids and then comminuting them in a blender. The released gases are interpreted to represent fluid trapped in the pores of the rock at depth and retained due to lack of interconnectedness of the pores with the mud system and atmosphere. The technique is useful, even when mud-gas data is available, because these loosely encapsulated fluids often provide better depth constraint on gas composition due to less commingling of the fluid from multiple gas-charged zones as the mud is circulated up the borehole.

Because rock porosities are on the order of a few percent, even in relatively tight rocks, and inclusion "porosities" are on the order of a few tenths of a percent, even in very inclusion abundant rocks, most of the signal in blended cuttings analysis represents pore fluid rather than fluid inclusion volatiles, and there is no attempt to distinguish between these respective signals in these conventional analyses. Distinction between, and measurement of both inclusion volatiles and gases in open microporosity (classically analyzed cuttings volatiles) is a clear improvement, as it allows for quantification both of pore volatiles representing fluids present in the system today, and fluid inclusion volatiles representing present or past fluids. Hence, measuring both allows distinction between present and past fluid charges.

In the cuttings volatile analysis mode of the current invention, the background is measured, and represents, cumulatively, gases from microporosity as well as those desorbed from accessible grain surfaces in the cuttings. This background comprises, substantially, the same gases analyzed during classical cuttings analysis described above, with the advantage of better resolution of higher molecular weight species because of the enhanced volatility of these compounds under high vacuum and slightly higher temperature as compared to ambient-pressure-temperature extraction.

The cuttings crush cycle then analyzes the added contribution from fluid inclusions, which can be distinguished from the previously measured background. High cuttings background in a specific zone suggests residual hydrocarbon within the pores, which in turn suggests either producible or immovable petroleum. The distinction between these two possibilities relies on the results of borehole volatiles analysis, which would generally indicate low petroleum readings in a residual petroleum occurrence that is immovable, but would typically display significant petroleum responses in a producible petroleum reservoir. If cuttings background is low, and there is no significant response from borehole volatile analysis (e.g., trap gas), but a significant response is obtained on analysis of fluid inclusion volatiles (i.e., upon crushing the cuttings after background analysis), then a past event is suggested. Recognition of this past event provides encouragement for continued exploration in the region, and in some cases might warrant redirecting the well trajectory.

The apparatus includes a mass spectrometric analyzer, a turbo-molecular vacuum pump, a diaphragm backing pump, a power supply, a relay board and solenoids for controlling automatic valves and heating devices and a high-vacuum manifold as shown in FIGS. 19, 20, 21 and 22. The entire apparatus can be controlled using a laptop, PC computer or other central processing unit. During operation, depending on the configuration of the valves in the manifold, the device can perform all of the three above-mentioned types of analysis (one at a time) and can be rapidly switched between modes in order to perform each type in a timely manner.

Figure 24:
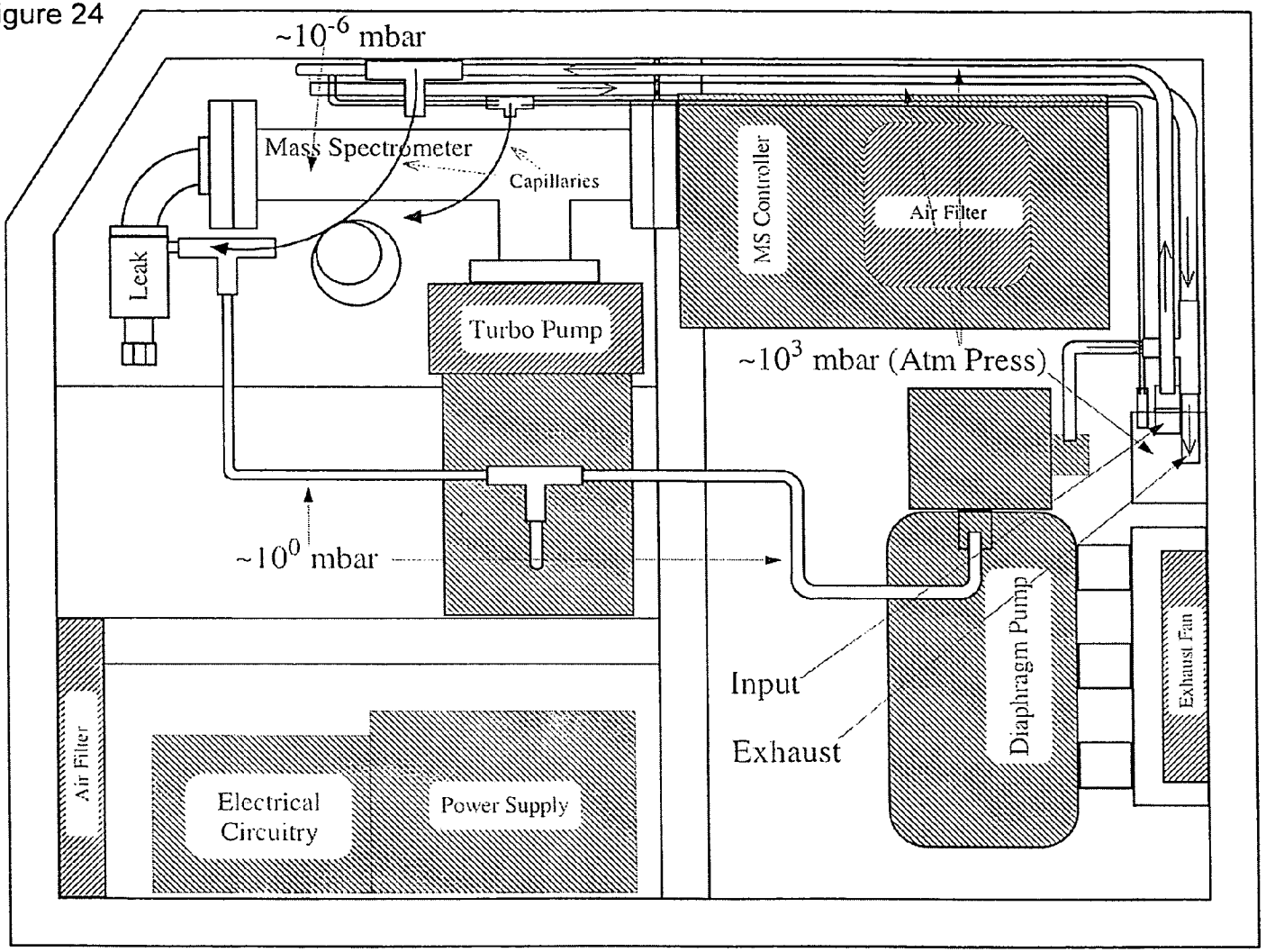
FIG. 24 is a diagrammatic representation of an alternate embodiment of an apparatus.

A related apparatus is described in FIG. 24 that provides only trap gas analysis. Similarly, devices may be constructed that allow only one of the other two modes of operation described above, or any two of the three modes described above by omitting the non-essential manifold components. In each case, the fundamental architecture is that embodied in FIG. 19.

The Preferred Embodiment and Description of Figures

Figure 19:
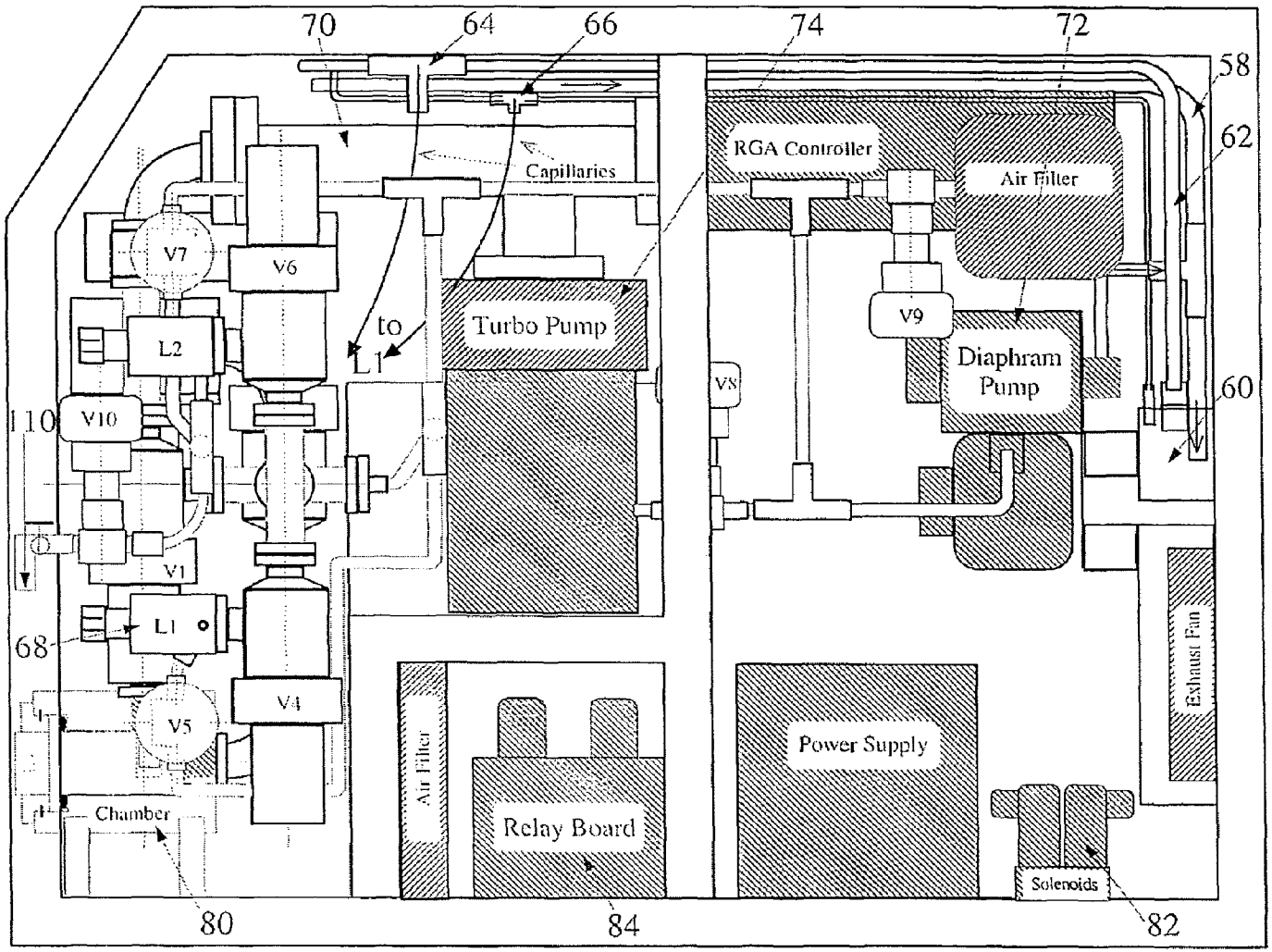
FIG. 19 is a diagrammatic representation of an apparatus constructed according to the present invention.

As seen in FIG. 19, trap gas from drilling fluid mud lines is directed to a bulk head 60, and is thereafter directed through line 62. Alternate capillaries 64 and 66 permit a portion of the gas to be directed past a leak valve 68 and thereafter to the input end of a mass spectrometer 70. The portion of the gas not delivered through the capillaries is returned via line 58.

Figure 20:
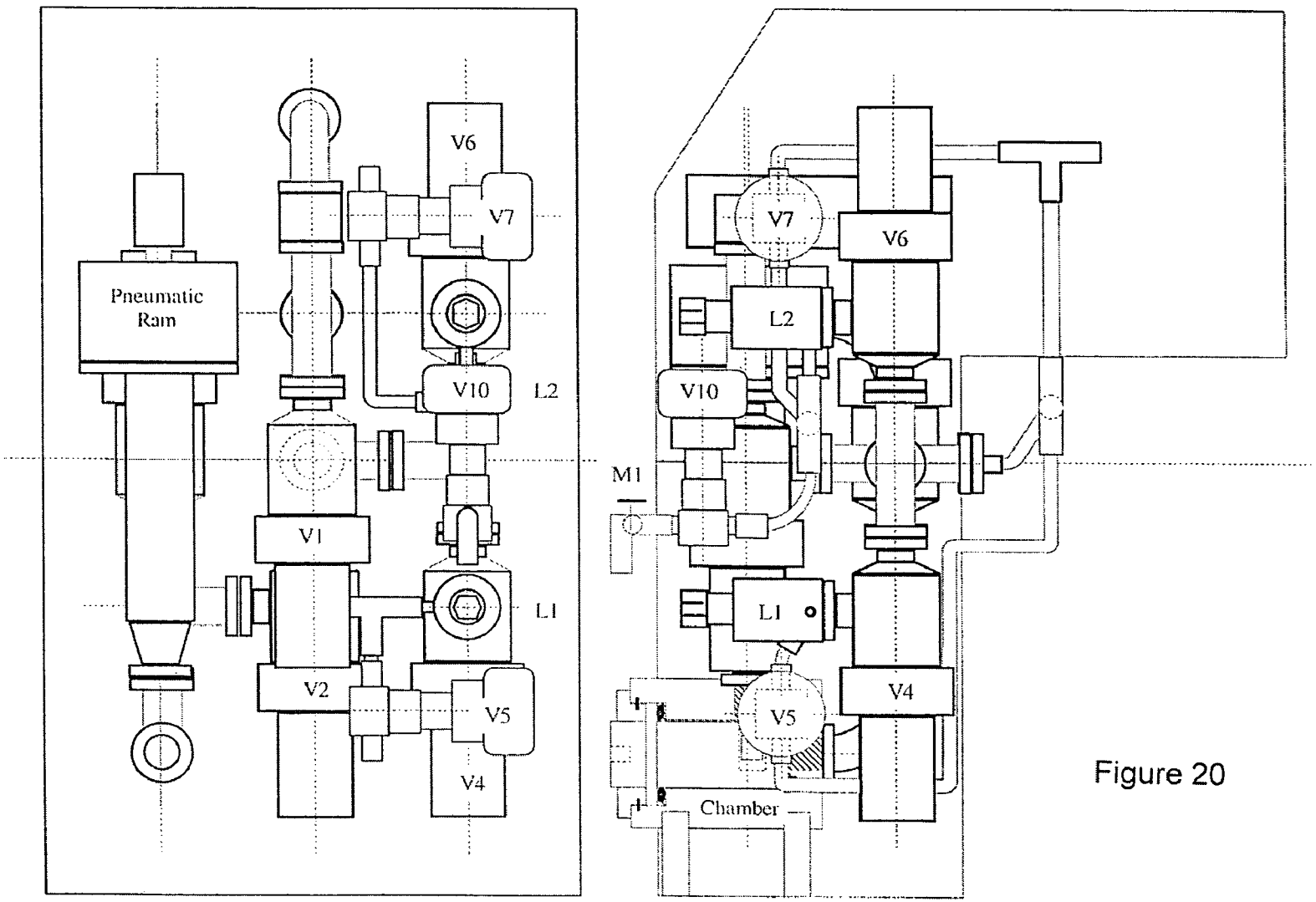
FIG. 20 illustrates both a front view and a side view of the apparatus shown in FIG. 19.

The mass spectrometer 70 contains a filament which is capable of ionizing molecules which are charged and then detected within the mass spectrometer detector. Vacuum pressure is supplied by the combined activity of a diaphragm pump 72 and a turbo pump 74. The quadrupole mass spectrometer and a turbo pumping system (turbo + diaphragm pumps) are capable of maintaining the total pressure in the ultra-high vacuum region in the range of $10^{-4}$ to $10^{-6}$ mbar. Gaseous species are introduced into the analyzer region of the mass spectrometer 70 through the manifold shown in the left portion of FIG. 19 and in FIGS. 20 through 23. Following their analysis, the species are pumped away as the turbo system continually operates. Front and side views of the sample introduction manifold are shown in FIG. 20 while a lateral cross-section is shown in FIG. 21.

In one embodiment, plumbing of the ultra high vacuum part of the manifold consists of ¾" nominal outside diameter OD stainless steel vacuum tubing connected in most cases using standard knife-edge flanges and copper gaskets or more rarely using viton O-ring seals. Valves V1-V4, and V6 are ultra high vacuum bonnet-type with viton seals. Leak valves L1 and L2 may be stainless steel construction with nickel diaphragms that provide controllable flow restriction when pressed against a circular annulus. Plumbing in the low-vacuum part of the manifold consists of ¼", ⅛", or 1/16" stainless steel tubing as indicated, (capillaries being 1/16") connected using swaged fittings. In addition to the standard vacuum components described above, there is a fixed aperture shown in FIG. 21 formed by machining a small hole in a solid copper gasket. Also a high-vacuum filter shown in FIG. 31 consists of, respectively, a circular O-ring retainer, an O-ring seal, a circular screen, a circular piece of filter paper, another screen, another O-ring, another O-ring retainer and a retainer clip all sandwiched together inside a larger aluminum cylinder. The cylinder also functions as a retainer for a standard viton O-ring manifold seal and is integral to preventing rock dust from invading parts of the high vacuum system other than the chamber.

Solenoids 82 control operation of the pneumatic valves and a relay board 84 drives and controls the solenoids.

Figure 21:
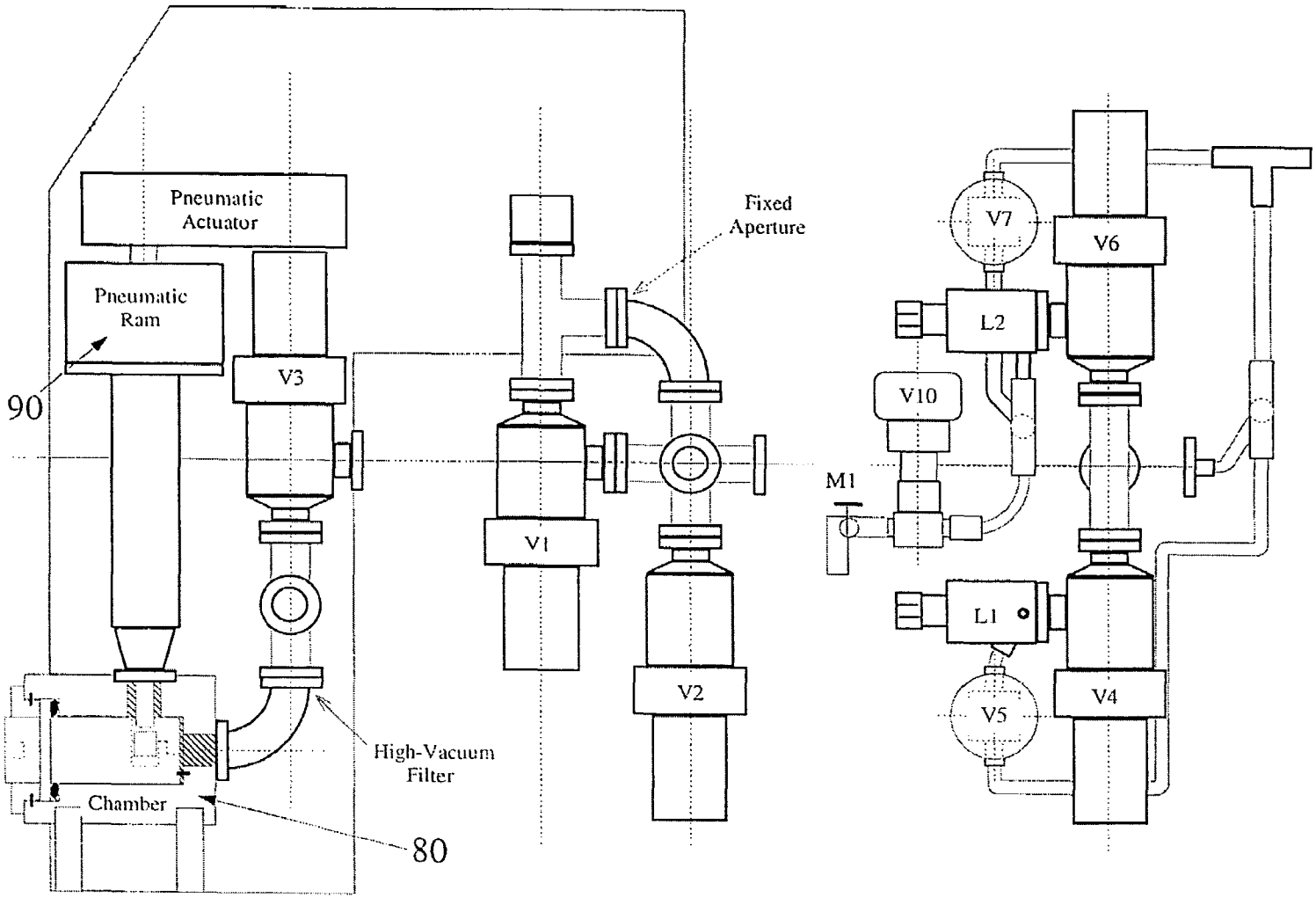
FIG. 21 illustrates three different side sectional views of the apparatus shown in FIG. 19.
Figure 22:
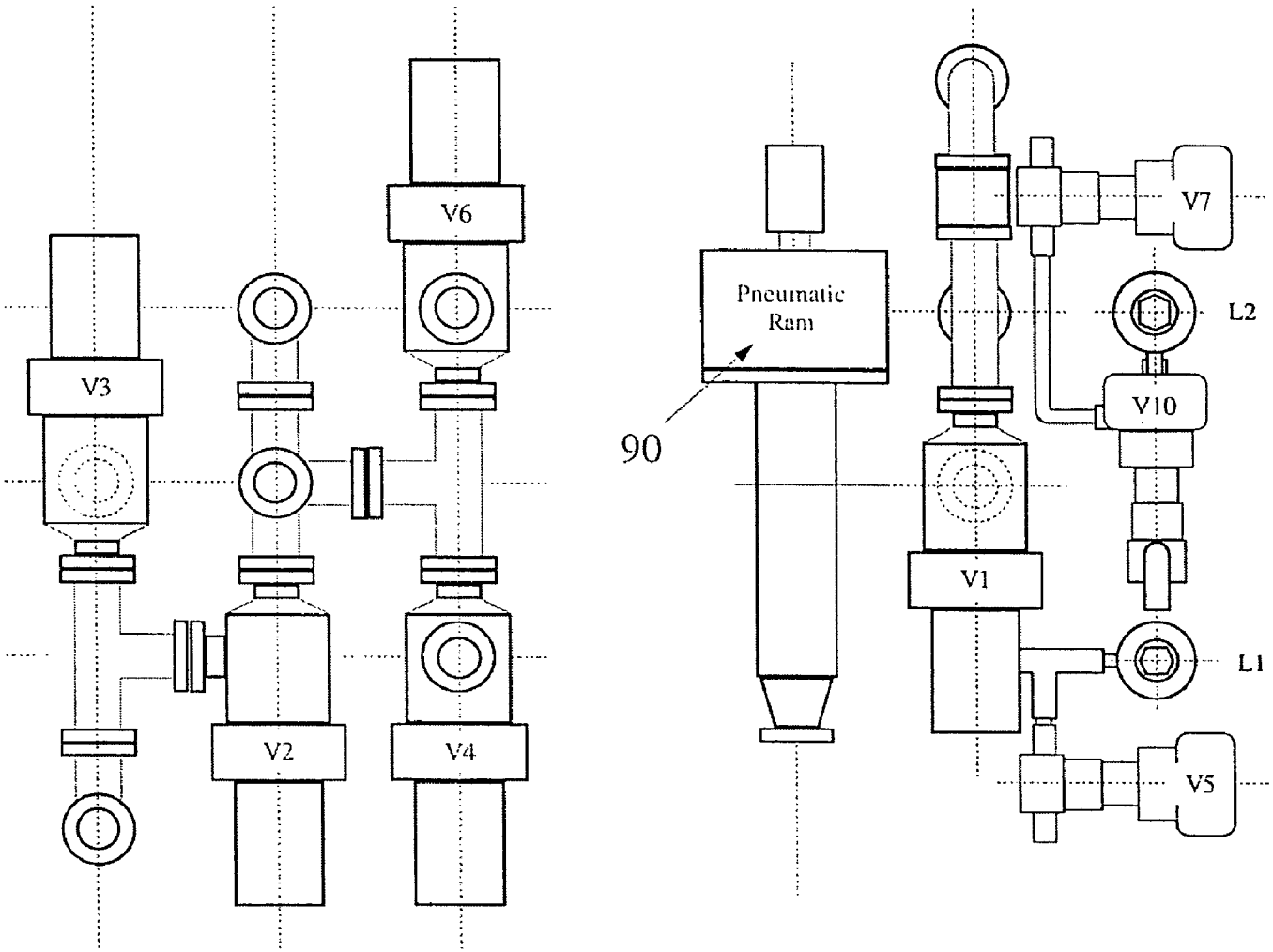
FIG. 22 illustrates alternate sectional views of the apparatus in FIG. 19.

Also shown in cross-section in FIG. 21, is the crushing chamber 80 into which rock samples are placed for analysis. The chamber has a removable probe that carries the sample into a position directly beneath a pneumatic ram 90. The chamber seals at the end in which the probe is inserted using a viton O-ring and a twist-lock mechanism. During operation, volatile gasses are released into the high vacuum system as the rock samples are crushed by the pneumatic ram 90. The volatiles should be released more-or-less instantaneously and the process should be non-thermal. An alternative embodiment is described later involving opposing mechanical cams or rollers.

Figure 23:
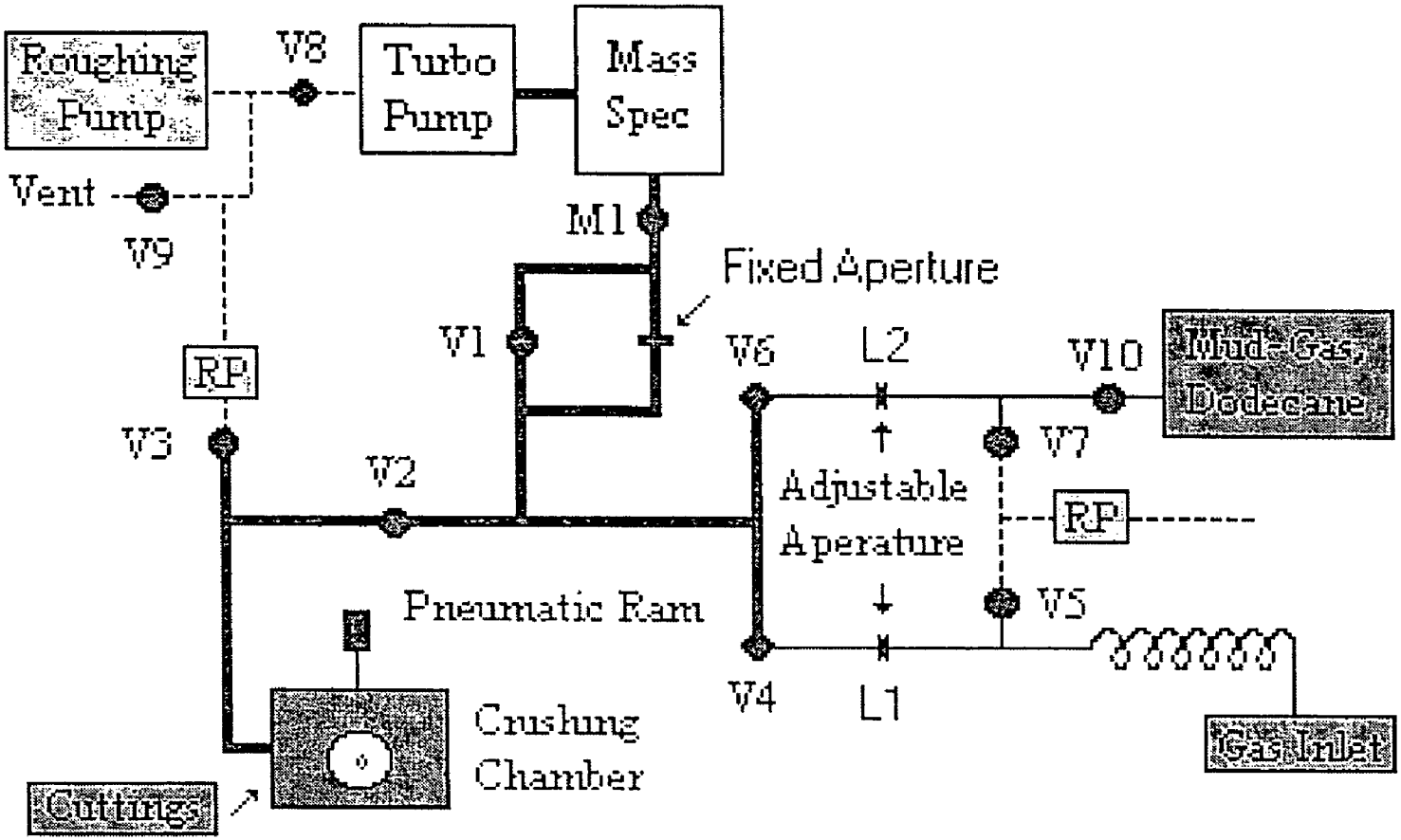
FIG. 23 is a schematic view of the apparatus in FIG. 19.

FIG. 23 is a simple schematic diagram of the apparatus depicting the relationship between the valves and other components.

FIG. 24 describes an alternate to the apparatus described in FIGS. 19-22 in which the capabilities of mud liquid and cuttings analysis have been omitted. Note that this configuration has no automatic valves and hence, no relays or solenoids. The trap gas sample is inlet through a capillary and subjected to a two-stage pressure reduction before entering the analytical region of the mass spectrometer. The first pressure reduction results as the gas passes through a 1-6ft section of $1/16^{th}$ inch stainless steel capillary into the low vacuum part of the manifold. The capillary having originated from within either a ¼" or ⅛" U-tube through which passes the trap gas. The second pressure reduction results as the gas passes through the leak valve set so that the total pressure reaching the probe is approximately $3\times10^{-6}$ mbar. An alternative embodiment involves substitution of this two-step pressure reduction configuration with a single step process toward the same end. In this case, the test gas at atmospheric pressure is forced past the adjustable leak valve immediately around the annulus-diaphragm contact and vented from a port on the opposite side from the inlet.

Operation of Apparatus

As set forth above, the apparatus provides for four different modes of operation. With the exception of the physical introduction of the sample in modes 2 and 4, all parts of the analytical routines described for modes 2, 3 and 4 below may be fully automated, and controlled using a proprietary computer software driver program. The following activities are those initiated via the computer software for each of the analytical modes 2, 3 or 4.

Mode 1: Diagnostics: The valves are configured by the computer for manual operation for testing purposes. Valves are initially in their ground state configuration, i.e., V1, V3, V5, V7, V8 opened; V2, V4, V6, V9, V10, M1 are closed. The mass spectrometer can be addressed in a command-line fashion to enable or disable any of its test features.

Mode 2: Mud Fluid Analysis: Valves V2, V4, V5, V3, remain closed isolating the trap gas and cuttings analysis portions of the manifold from the portion involved in mud fluid analysis. A glass tube 110 with one end sealed by fire and containing a sample of the mud to be analyzed is attached to the inlet port near manual valve MI. The inlet port has an O-ring seal to facilitate this attachment. Valve V8 is closed isolating the low-vacuum side of the turbo and V10 and V7 are opened leaving the left side of M1 in communication with the diaphragm pump. The computer prompts the operator and M1 is slowly opened manually until minimal effervescence is observed in the mud sample and then the valve is opened fully. The operator then returns control to the computer and V7 and V1 are closed and V6 is opened. When the total pressure on the probe drops below $5\times10^{-5}$ mbar, V1 is re-opened and the sample gas entering through the adjustable aperture between V10 and V6 is analyzed. The analysis is performed either using continuous scans or a combination of continuous and step scans, (each having different dwell duration on each mass or spectral segment and different gain settings of the electron multiplier) in order to accentuate the resolution of different portions of the spectra.

Following spectral analysis, V6, M1 and V8 are closed and the part of the manifold on the low vacuum side of V6 is purged twice with atmosphere through V9. The system is then returned to the ground state valve configuration at the end of the cycle.

In summary, the mud fluid sample analysis is performed by obtaining a sample of the liquid mud fluid and applying a vacuum to remove gases.

Mode 3: Trap Gas Analysis: Valves V2, V3, V6, V7, V9, V10 remain closed isolating the mud liquid and cuttings analysis portions of the manifold from the portion involved in trap gas analysis. From the ground state valve configurations, V1 is closed and V4 is opened. When the total pressure on the probe drops below $5\times10^{-5}$ mbar, valve V1 is re-opened and the sample gas entering through the adjustable aperture between V4 and the capillary adjoining the gas inlet is analyzed. The analysis is performed either using either single, slow, continuous scans or a combination of continuous and step scans, (each having different dwell duration on each mass or spectral segment and different gain settings of the electron multiplier) in order to accentuate the resolution of different portions of the spectra. Combining a single continuous scan at a moderate rate and multiplier gain with several slow step scans at higher gain and over limited mass can, for example, provide the necessary resolution of important features using a substantially shorter cycle time than slow, continuous scanning of the entire mass range. Regardless of whether the final analysis is the result of a single scan or its reconstitution from parts of many individual sub-scans, a key feature of the present implementation and of the use of the quadrupole for trap gas analysis in general is that the cycle time can be effectively varied between approximately 15 seconds to more than 6 minutes. This inherent flexibility is absent in the gas chromatographs presently in use for trap gas analysis and yet is tremendously important in that it allows more rapid analysis (shorter cycle times) to be achieved in response, to faster drilling rates or stronger responses.

At the end of a given spectral analysis, the system retains the above valve configuration and immediately enters another analytical cycle. The system only is returned to the ground state valve configuration at the end of the cycle if a different mode of operation has been selected at some point during the cycle. In other words, during continuous operation of the trap gas analysis mode, no valves are either opened or closed. Thus, in the case where the device will not be used for mud liquid or cuttings volatiles analysis, no valves are required and the alternate apparatus shown in FIG. 34 is appropriate.

Mode 4: Cuttings Volatile Analysis: Valves V4, V5, V6, V7, V10 and M1 remain closed isolating the trap gas and mud liquid analysis portions of the manifold from the portion involved in cuttings volatile analysis. At the start of the analytical cycle, valve V8 is closed and the diaphragm pump de-energized and V9 is opened to allow the chamber to vent. The computer then waits while the sample probe is removed, filled with rock sample and replaced by the operator. The control is then returned to the computer and V9 is closed. The diaphragm pump is re-energized and the chamber is rough pumped. After 1 minute, V8 is reopened and the diaphragm pump continues to back the turbo. Next, V1 and V3 are closed and V2 is opened allowing chamber gas to enter the analytical region of the mass spectrometer via the fixed aperture. When the total pressure falls below $5\times10^{-5}$ mbar as determined by the mass spectrometer, V1 is re-opened and the system continues to pump down until the total pressure falls into the $10^{-6}$ mbar range. At this point, V1 is again closed, and after a 30 second dwell, the mass spectrometer scans the mass range 50-100 four times in rapid succession with the electron multiplier set at a relatively high gain. The multiplier is then set to a relatively lower gain and then nine scans of the mass range 1-50 are performed in rapid succession. At the start of the fifth scan of the low-mass range, the disintegration device is triggered and the rock sample is pulverized and a substantial portion of its volatile content released into the vacuum. The $6^{th}$ through the $9^{th}$ scans capture much of the released gases in this mass range. The mass spectrometer is then re-configured again for the high-mass range and four more scans are performed. Subsequently, the scans before the disintegration are reduced by exponential curve fitting and extrapolation to intensities at t0 (the time of disintegration) and used to construct a composite representing the background gas analysis in the chamber prior to rock-volatile release. Those spectra acquired following disintegration are mathematically reduced in a similar manor to construct a composite representing the background plus the evolved volatiles. The contribution solely from the rock volatiles is then taken as the difference between these two composites.

At the end of the cycle, the system is returned to the ground state valve configuration as previously described.

Figure 25:
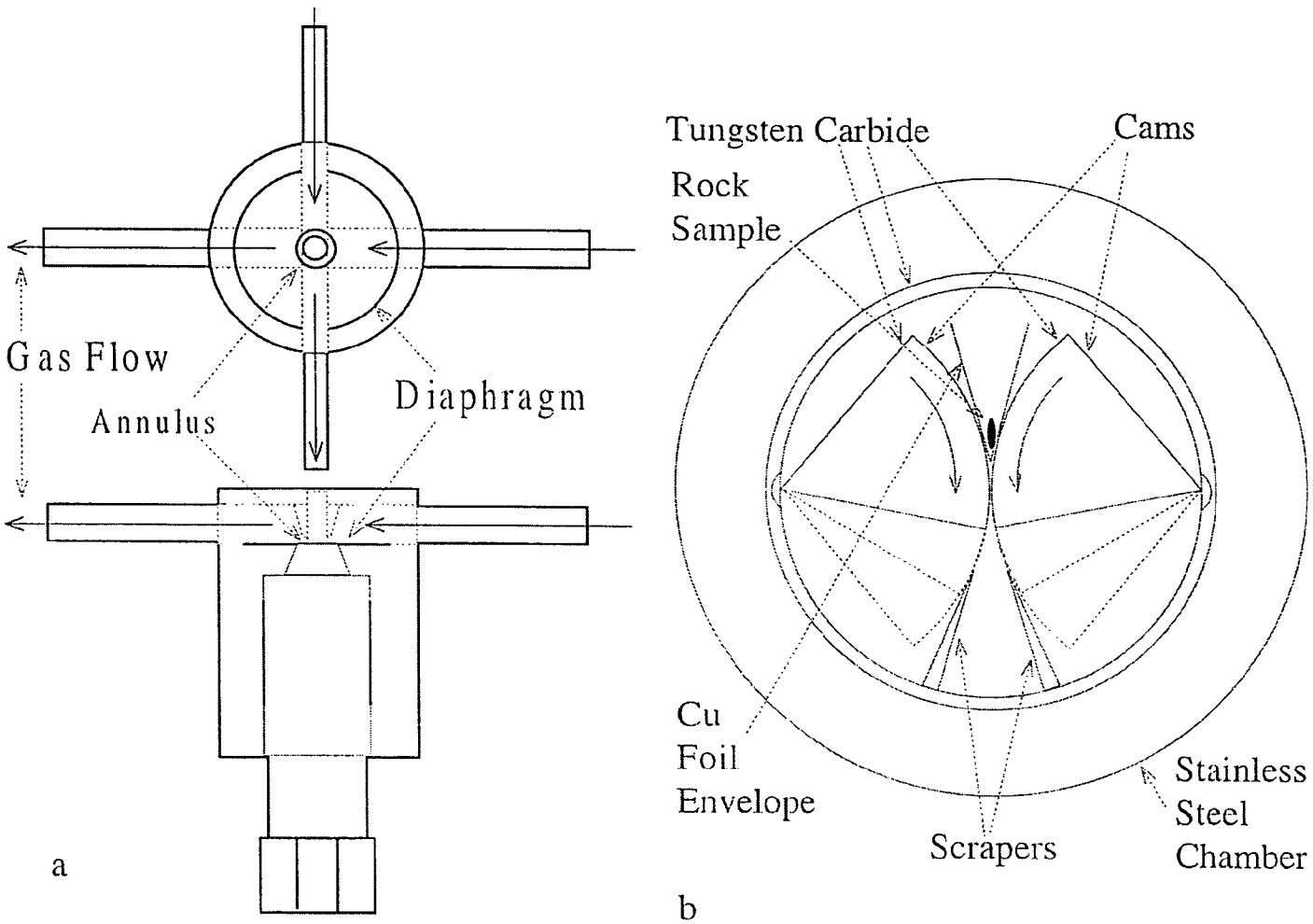
FIG. 25 illustrates an alternate leak valve and an alternate crushing chamber.

Alternative Embodiments (FIG. 25)

1) Alternative to two-stage pressure reduction procedure for sampling trap gas. FIG. 25*a* shows the apparatus for introducing trap gas into the analytical region of the mass spectrometer involving a single-step pressure reduction process. Pressure reduction occurs entirely at the annulus-diaphragm interface of an adjustable leak valve. This interface is continually "bathed" by a constant flow of trap gas entering the pressure reduction region from one side and exiting on the other. Response time is minimized by reducing the dead volume on the high-pressure side of the aperture to effectively zero by constant refreshment of the trap gas in the critical region. In the application of the apparatus to trap gas analysis, if the leak becomes plugged—partially or completely, an immediate pressure drop will be recorded on the mass spectrometer and thus, the condition will be easily detected. For the case where the trap gas will be at times supplied through a ¼" diameter feed tube and at other times by one having ⅛" diameter, an alternative configuration is provided in which both trap gas flow paths are superimposed on a single leak valve and at right angles to one another. The entry and exit ports made from the unused diameters are blocked off as close to the annulus-diaphragm interface as is convenient.
2) Alternative to pneumatic ram for mechanical disintegration of rock samples. FIG. 25*b* shows the device for disintegration of rock samples. The rock material is placed on a trough-shaped piece of copper foil and passed between two opposing cams set apart at distance approximately equal to twice the thickness of the foil. The cams are made of tungsten carbide or another similarly hard metal and are made to rotate rapidly with a downward motion. As the foil + sample pass between the cams, the rock material is disintegrated and encased in the foil thereby allowing the escape of volatiles while trapping the majority of the rock dust by embedding it in the foil. As the foil + sample emerges from the lower side of the cams, fixed location scrapers pluck the spent charge from the surface of the cams and allow it to settle to the lower portion of the chamber for subsequent removal. This device would replace the chamber of FIGS. 19-24. An additional alternative involves replacement of the cams described above with cylindrical hardened-steel rollers rotating about their centers also placed a distance apart of approximately twice the thickness of the foil.
3) Alternative to slow, continuous scan over full mass range during mud fluid or trap gas analysis. While the preferred embodiment for analytical data acquisition during mud fluid or trap gas analysis is slow, continuous scanning over the entire mass range of interest, instances arise where it is not practical or feasible to collect data at such a leisurely pace. In such cases, analysis is accomplished by performing a relatively rapid scan over a portion of the desired mass range where the signal strength is high and counting statistics are favorable even during a rapid scan. Selected masses or mass ranges are subsequently re-scanned at a lower scan speed and commensurately higher gain on the electron multiplier in order that these regions be better resolved. By judicious choices of scan rates, and scan ranges a relatively larger analytical dynamic range can be achieved for the analysis as a whole and special attention can be given particular regions of interest resulting in their analysis with relatively higher sensitivity while, at the same time, the entire analysis can be accomplished in a shorter cycle time.

The mass spectrometer performs analyses by ionizing molecular species, separating these species according to their MCR, amplifying the signal and measuring the signal for each MCR.

Ionization results in fragmentation of parent species in a potentially complex, but repeatable, manner. Unlike, GC-MS, straight MS can result in multiple ions occurring at the same MCR (e.g., the molecular peaks of carbon dioxide and propane at MCR 44). These potential interferences can be overcome by selecting other MCR that have contributions from one but not the other element or compound of interest (e.g., MCR 22 for doubly-charged carbon dioxide and MCR 41 for the singly-charged C3H3 fragment from propane). The abundance of these alternate MCR is proportional to the abundance of the molecular peak, hence can be used to indirectly quantify the amount of the species of interest. Quantitative analysis of individual organic species containing several or more carbon atoms is not feasible due to the potential contribution of many individual compounds to the same MCR. However, a given class of organic compounds tends to contribute to the same series of MCR and be minimal contributors to other MCR that are contributed to predominantly by a different class or family of organic compounds. For instance, paraffin compounds having 4 or greater carbon atoms tend to contribute to MCR 57, while aromatic compounds tend to contribute to MCR 51. Paraffin compounds tend to contribute to MCR 57, 71, 85, etc., while naphthenic species contribute to MCR 55, 69, 83, etc. This characteristic allows major classes of hydrocarbon compounds to be identified and their relative contribution to the total volatile signal evaluated.

The MCR of some species that have been found to be important to quantify are shown in Table 1.

Presentations of data produced from the method and apparatus outlined herein can be logarithmic or linear and can involve plots of single MCR, MCR ratios, or specific summations of groups of MCR as a function of depth. These MCR, ratios or specific summations are chosen based on their ability to define specific fluid processes or fluid histories occurring in the subsurface or occurring as part of the drilling process. The zones from which the processes are inferred may be defined by relative abundance or lack of abundance of one or more elements or compounds of interest. The ultimate goal of the display of these MCR is to guide exploration, exploitation or drilling activities, preferably in the short term.

Any one of the three types of analysis, namely gas trap volatiles, mud volatiles or cuttings volatiles, can be used in isolation to produce useful information for guiding exploration and drilling operations. However, without limiting the invention, the combination of two or more of these data sets produces a more complete record of subsurface processes, as will be seen in the examples below. Briefly, cuttings volatiles are generally dominated by past fluids, which may or may not be present today. Present-day pore fluids that have significant vapor pressure at atmospheric conditions generally dominate trap gas. Mud volatiles may contain significant concentration of species that are not adequately represented in the trap gas either because of reduced vapor pressure and/or because they are strongly fractionated into the mud system as compared to the atmosphere. High molecular weight organic species may be an example of the former, while some water-soluble compounds (e.g., organic acids) may be an example of the latter. Additionally, the mud volatiles analysis has less interference from atmospheric species, such as nitrogen, oxygen and carbon dioxide. The presence of these species in gas trap volatiles makes difficult the analysis of subsurface concentrations of these species, and species with the same or closely positioned MCR from trap volatiles alone, unless these species are present in appreciable quantity.

An additional advantage of on-site borehole volatiles and cuttings volatiles analysis is that rock samples can be collected and their volatiles analyzed based on the results of borehole volatiles analysis, which is more continuous. Presently, cuttings are collected at prescribed intervals without substantial regard to the composition of the gases emanating from the borehole. With methods and apparatus outlined in the invention, rock-sampling programs can be guided more fully by borehole volatiles analyses, due to the increased amount of information provided. As cuttings samples are often the only record of the rock that was penetrated, it is critical to sample and archive the most appropriate depths, namely, those that may have or may have had hydrocarbons or potential source intervals associated with them. Thinly bedded units, in particular, can benefit from such directed sampling.

These following examples illustrate the utility of the data generated from the method and apparatus forming the invention.

Applications to Barren Reservoirs

Figure 1:
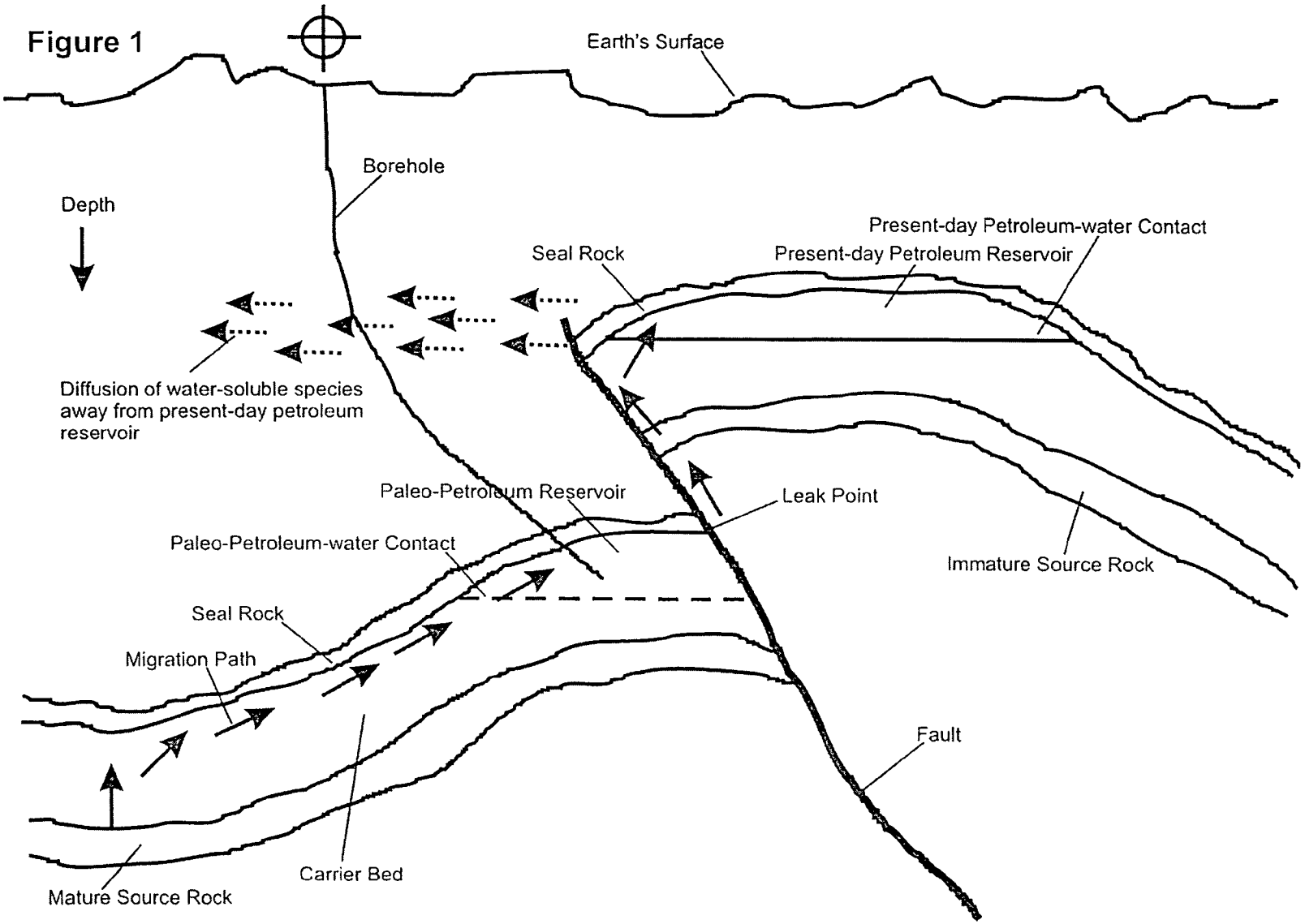
FIG. 1 shows a borehole that penetrates a water-bearing reservoir section, which had a paleo-column of oil that leaked at the leak-point to a shallower reservoir.

FIG. 1 illustrates the critical features of a hypothetical petroleum system, including a mature source rock, from which hydrocarbons are produced and expulsed, a carrier bed through which the petroleum species migrate along a migration path, an overlying seal unit, which prevents most of the petroleum from escaping the carrier bed, a paleo-reservoir in which petroleum was reservoired for a period of time in the geologic past, the extent of the paleo-petroleum column being defined by the paleo-petroleum-water contact, a fault which acted as both a temporary lateral seal for the paleo-petroleum column, and, more recently allowed petroleum to re-migrate from the paleo-petroleum reservoir to the present-day petroleum reservoir through a leak point. The limits of the present-day petroleum column are defined by the present-day petroleum-water contact. The present-day petroleum reservoir is floored by immature source rock, which is incapable of generating significant petroleum, due to insufficient burial temperature related to shallower depth of burial, as compared to the mature source rock.

FIG. 1 shows a borehole that penetrates a barren, water-bearing reservoir section, which had a paleo-column of oil that leaked at the leak-point to a shallower reservoir. It will be appreciated that with current wellsite technology it is not possible to discover at the wellsite in essentially real time the reason why the trap does not contain hydrocarbons, whether it was charged in the past, whether petroleum ever moved through it, or judge the integrity of the seal over geologic time. As discussed below, the real-time aspect of the invention is critical because it allows well drilling, completion and short-term exploration decisions to be made that will result in lower energy finding costs.

Figure 2:
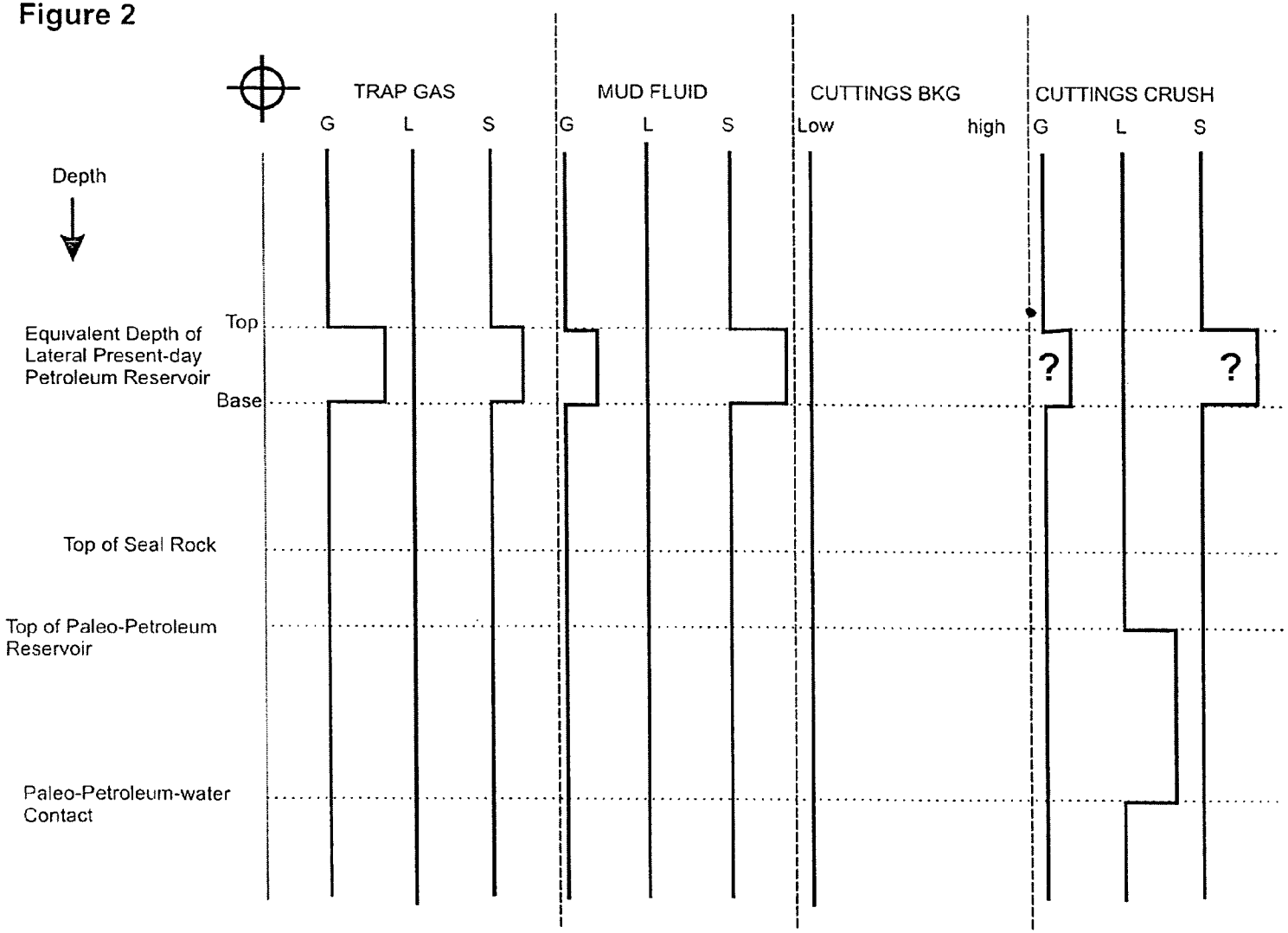
FIG. 2 shows schematic results of borehole volatiles and cuttings volatiles analysis for the geologic scenario represented by FIG. 1 using the method and apparatus of the invention.

The schematic results of borehole volatiles and cuttings volatiles analysis for the geologic scenario represented by FIG. 1 using the method and apparatus of the invention is illustrated in FIG. 2. The figure displays the results of four data sets collected by the apparatus, namely, volatiles from the trap gas (trap gas), volatiles extracted directly from the mud (mud volatiles), volatiles desorbed from rock material in the vacuum chamber before crushing as background volatiles (cuttings background) and volatiles collected from fluid inclusions within rock material upon crushing that material in a vacuum chamber (cuttings crush).

The signal output of the apparatus is highly simplified for the purposes of discussion, into gaseous petroleum indications (G), liquid-petroleum indications (L) and water-soluble organic and inorganic species indications (S). The actual chemical information plotted in each case may be a combination of single MCR, ratios of MCR or summations of several MCR, and may consist of several curves, as opposed to the single curve displayed on the example diagrams for each indication. It is understood that the displayed curves do not necessarily indicate the presence or absence of an individual compound, but, rather, that multiple curves for each indication cumulatively suggest the presence or absence of the key compounds grouped under each indicator heading (G, L and S). Suggested MCR for each indicator group are enumerated in Table 1. Distinction among G, L and S indications, or some combination thereof, can be made by anyone skilled in the art of interpreting data from mass spectrometers, or can be made by various computer algorithms designed to interpret these data. Potential differences between the trap gas and mud volatiles are displayed schematically. In general, detection of species that have low vapor pressures and/or are hydroscopic will tend to be enhanced in the mud volatiles and may be present in reduced concentration in the mud gas, even to the point of being below the detection limit of the apparatus. The opposite is true for species that have significant volatility and/or are hydrophobic; namely, they will be better represented in the trap gas. Thus, although there may be substantial overlap in the information provided by the trap gas and mud volatiles in some cases, the analysis of both may be required for adequate chemical characterization of the borehole volatiles in other cases. It is an underlying theme of the present invention that each of the three main portions of the analysis (trap gas, mud volatiles, and cuttings background and crush) is useful in isolation. However, the preferred embodiment of the invention involved combination of two or more of these individual analysis and interpretation of the combined results.

In the geologic scenario defined by FIG. 1 and data shown on FIG. 2, S indications at the equivalent depth of the lateral present-day petroleum reservoir are sourced from the petroleum accumulation via diffusion of these species away from the accumulation through an aqueous-dominated pore fluid that is in communication with the accumulation. The presence of these species is, thus, indicative of the presence of the adjacent reservoir. The detailed chemistry of the S indications can be used to distinguish between proximal gas and proximal oil or condensate occurrences. S indications are best developed in the borehole volatiles profile, and may display fractionation effects between mud volatiles and trap gas volatiles as shown schematically by relative magnitudes of indicators. The G indications in trap gas and mud volatiles in this example represent low molecular weight petroleum species with significant solubility in water dissolved in the aqueous pore fluid. S and G species may also be represented in the cuttings crush data, although these are not as reliably present as those in the borehole volatiles data, as indicated by the question mark.

The distance away from the reservoir may be calculable from the concentration of these species in the analyzed fluid, provided sufficient information is known and the data are appropriately calibrated. Prior art has used this approach for benzene concentrations to determine the distance to the sourcing reservoir (eg Burkett & Jones 1996 Oil and Gas Journal). In that method, however, determinations were made by collecting samples from formation tests of specific reservoir units after the well was drilled, and transporting them to a laboratory where they were analyzed using standard wet-chemical techniques. These tests are generally not performed on known water-bearing sections. They are usually performed where standard mudlogging practices and gas detection equipment has indicated the possible presence of hydrocarbons. The ability to provide this same information in real time, and continuously throughout all penetrated formations, even those with no standard mudlogging hydrocarbon shows, without the need for expensive testing operations or sample coordination, is a clear improvement over existing art.

In the paleo-petroleum reservoir, borehole volatiles data detect no hydrocarbons, while cuttings volatiles reveal the presence of liquid indicator anomalies that define the paleo-petroleum accumulation, including the paleo-petroleum-water contact. Specific indicators define the petroleum phase that was present in the system, be it gas, condensate or oil. In this case, oil is suggested. The abrupt top of the anomaly, which correlates with the base of the top seal, implies that the reservoir did not leak because of top seal failure. A lateral seal failure, in this case the fault, is implicated. The volume of leaked oil may be determined from the paleo-petroleum-water contact and the volume of the target structure. Cumulatively the data from borehole and cuttings volatiles analysis using the methods and apparatus of the invention suggest the presence of a shallower oil accumulation that may represent remigrated fluids from the target reservoir at the well penetration location. Depending on the ability to define the location of the charged structure with additional geologic information, such as structural maps or seismic data, a sidetrack of the well may be recommended, or a new borehole may be drilled. It can be appreciated that without the information provided by the method and apparatus covered in this invention there would be no encouragement to drill this adjacent well and there would be no evidence for the previous existence of an oil column within the barren target reservoir.

Figure 3:
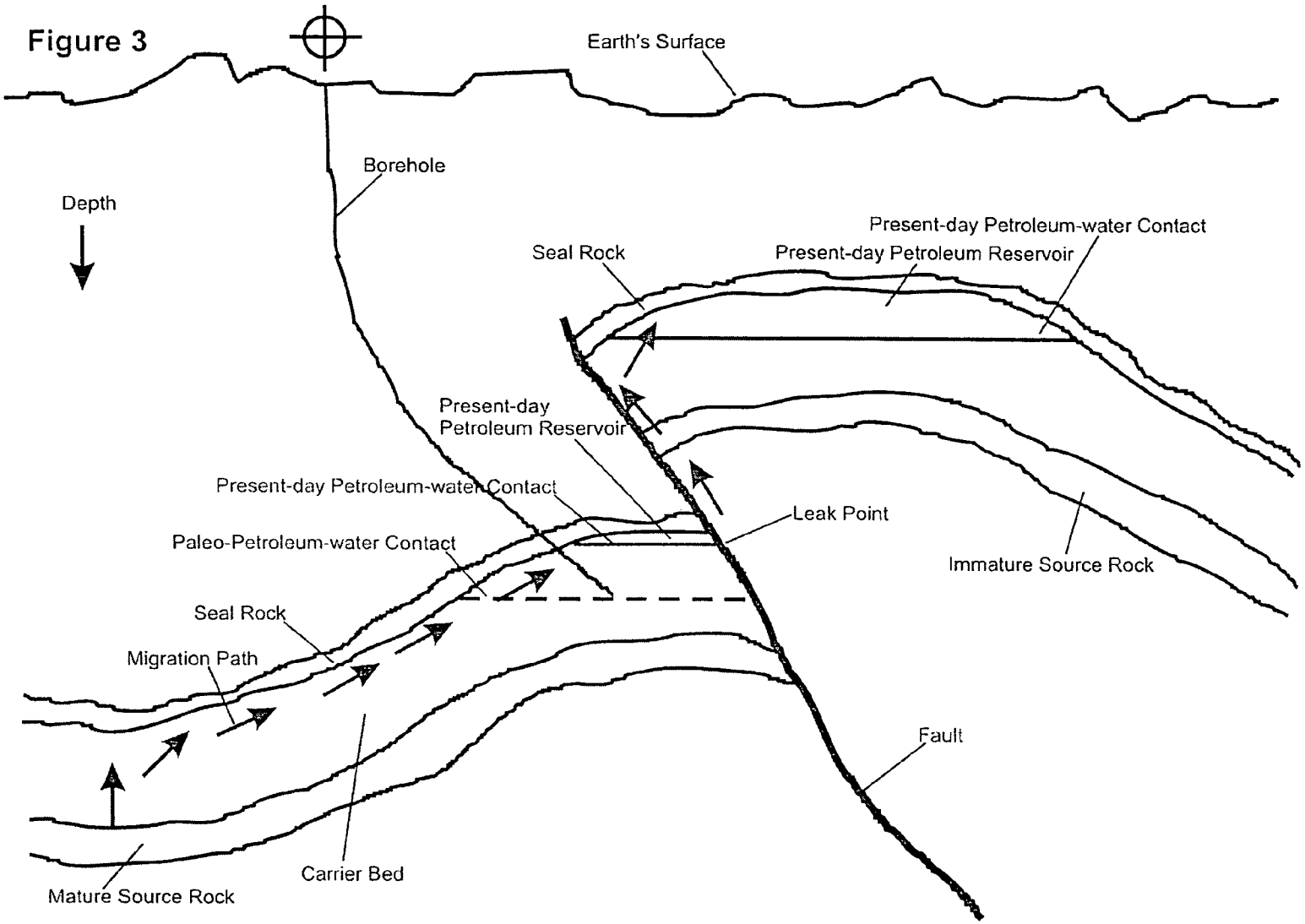
FIG. 3 shows the same elements as FIG. 1. It is similar in that the borehole penetrated a water-bearing reservoir section, which had a paleo-column of oil that leaked at the leak-point to a shallower reservoir. In this case, however, there is a smaller oil column in the updip portion of the target reservoir itself, in addition to the shallower reservoir.

FIG. 3 shows the same elements as FIG. 1. It is similar in that the borehole penetrated a water-bearing reservoir section, which had a paleo-column of oil that leaked across the fault at the leak-point to a shallower reservoir. In this case, however, there is an oil column remaining in the updip portion of the target reservoir itself, in addition to remigrated oil in the shallower reservoir.

Figure 4:
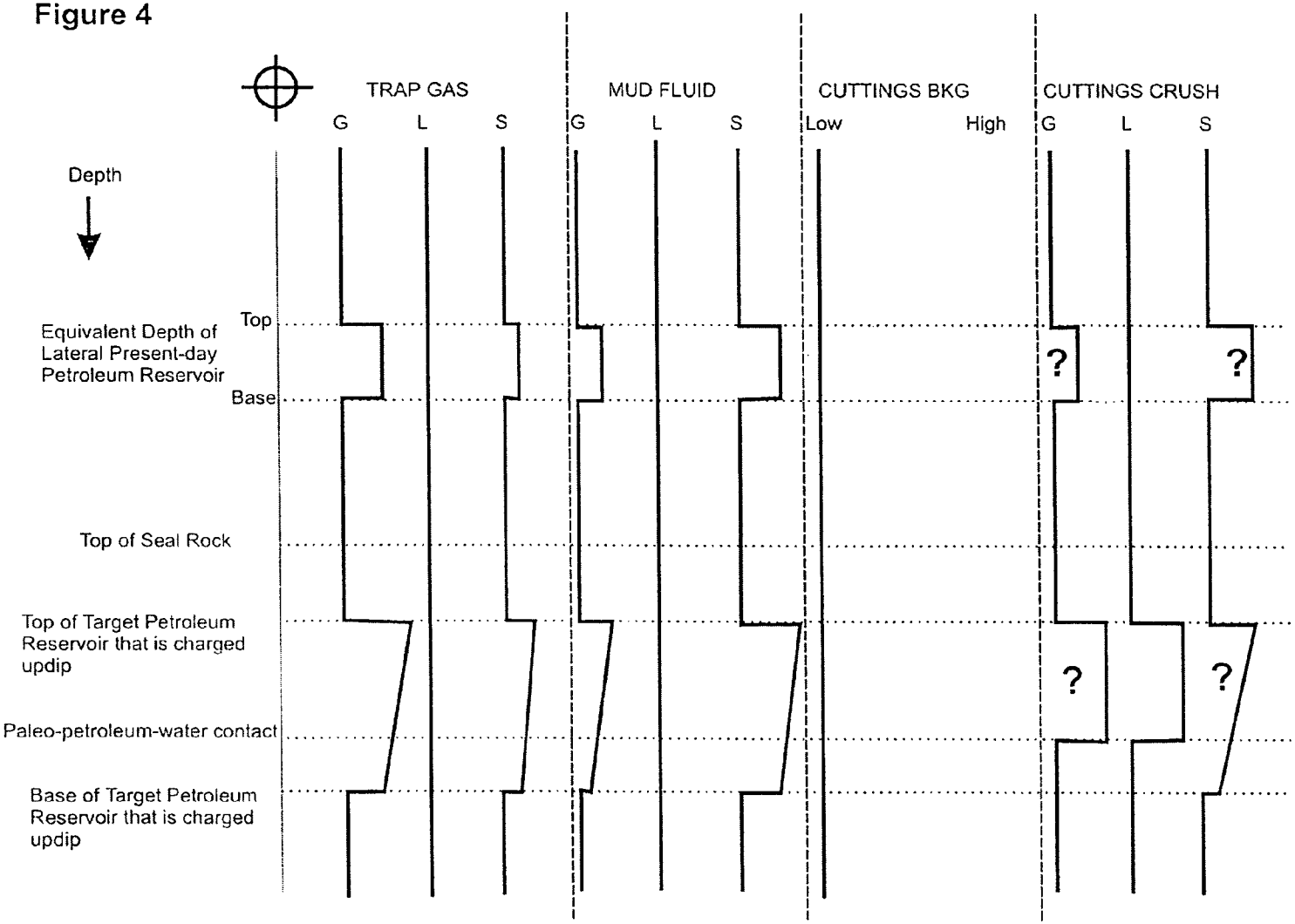
FIG. 4 shows the schematic results of borehole volatiles and cuttings volatiles analysis for the geologic scenario represented by FIG. 3 using the method and apparatus of the invention.

FIG. 4 shows the same elements as FIGS. 2 and indicates the results of borehole volatiles and cuttings analysis of the borehole represented in FIG. 3. In this example, S indications at the equivalent depth of the lateral present-day petroleum reservoir are indicative of the presence of this reservoir, and possibly the distance to this reservoir. The G indications in this case represent low molecular weight petroleum species dissolved in the aqueous pore fluid at this level. S and G species may also be represented in the cuttings crush data, although these are not as reliably present as those in the borehole volatiles data, as indicated by the question marks. In the paleo-petroleum reservoir, borehole volatiles data detect similar S and G indications sourced from the updip charge in the target reservoir. Responses may be stronger than the shallow indications from the lateral reservoir, due to the shorter and less tortuous migration route of the soluble species in the target reservoir. Cuttings volatiles reveal the presence of oil indicator anomalies that define the paleo-petroleum accumulation, including the paleo-petroleum-water contact. The abrupt top of the anomaly, which correlates with the base of the top seal, indicates that the reservoir did not leak because of top seal failure. A lateral seal failure, in this case the fault, is implicated. Nevertheless, S and G species in the target reservoir section indicate that the leakage was not complete. S and G species may also be represented in the cuttings crush data, although these are not as reliably present as those in the borehole volatiles data, as indicated by the question marks. Cumulatively the data suggest the presence of a shallower oil accumulation that may represent remigrated fluids from the target reservoir. Additionally, a remaining, albeit smaller, oil column is indicated in the target reservoir. The minimum volume of leaked oil may be determined from the paleo-petroleum-water contact, the borehole location and the volume of the target structure. Depending on the economics of the updip remaining oil column, and the ability to define the location of the shallower offset charged reservoir with additional geologic information, such as structural maps or seismic data, a sidetrack of the well may be recommended, and/or a new borehole may be drilled.

Applications to Penetrated Petroleum Reservoirs

Figure 5:
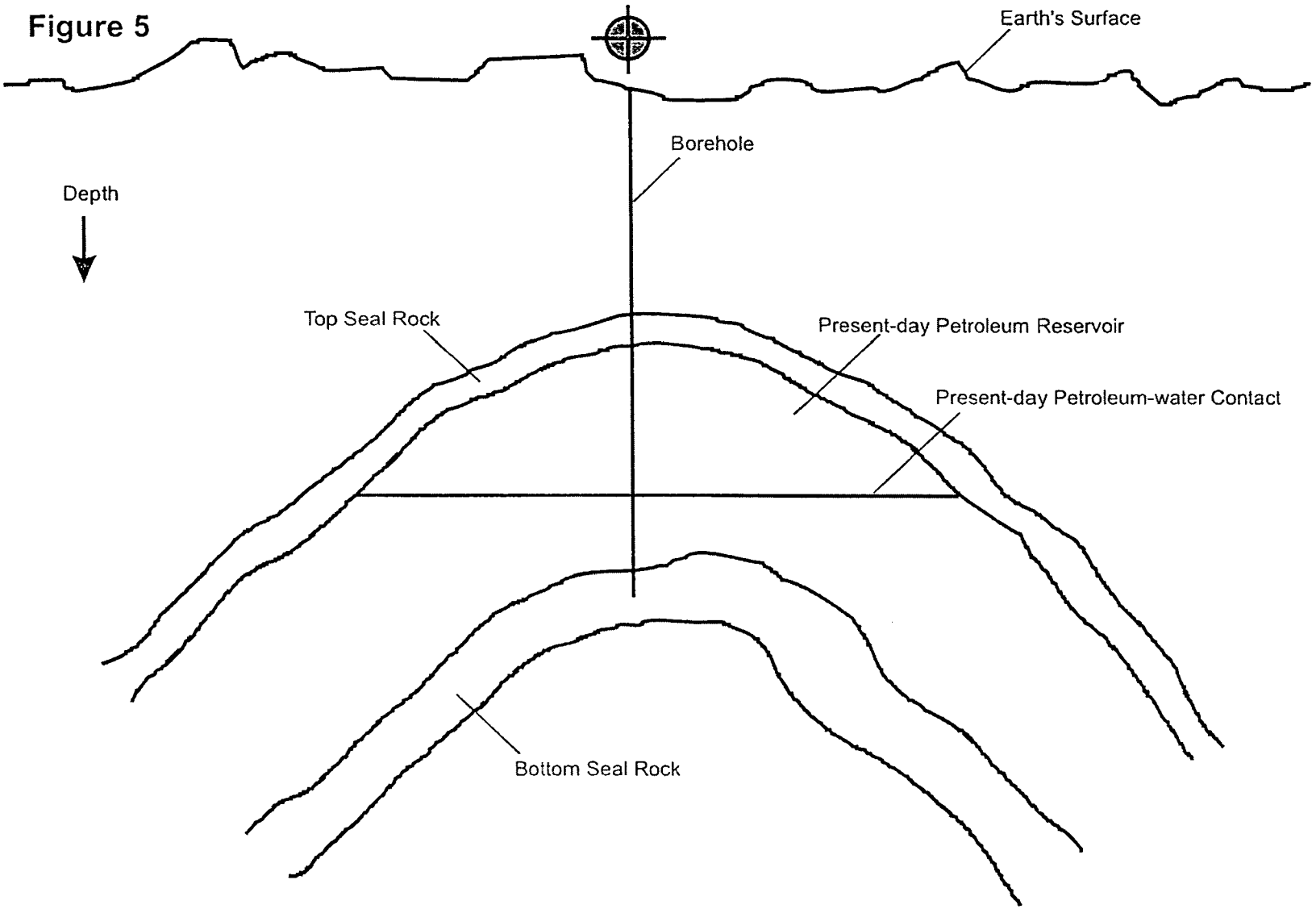
FIG. 5 illustrates a penetrated oil reservoir with top and bottom seals and illustrates the position of the present-day petroleum-water contact.

FIG. 5 is a schematic of a petroleum-bearing geologic structure that is penetrated by a borehole. The reservoir, top and bottom seals and position of the present-day petroleum-water contact are illustrated. Part of the drilling procedure involves controlling and maintaining the weight of the mud system so as to form a column of mud in the borehole that, ideally, is neither too heavy nor to light. This prevents both costly loss of fluid to the formation, as well as potentially hazardous and uncontrolled fluid loss from the formation to the borehole. A mud system that is heavier than necessary to keep pore fluids from entering the borehole is termed over-balanced, while one that is not heavy enough to prevent continuous ingress of fluids from the formation is termed under-balanced. A mud system that has a weight that more-or-less matches the entry pressure of the formation fluids at each depth can be termed neutral-balanced. This latter condition is desirable in most cases, but there are geologic or economic considerations that necessitate over-balanced or under-balanced drilling or make these conditions more cost-effective. Under-balanced drilling might be used, for instance, where a pressure regression is expected at depth, which might cause excessive mud loss to the formation. Over-balanced drilling might be used where a deeper overpressured section is expected, but cannot be anticipated.

Figure 6:
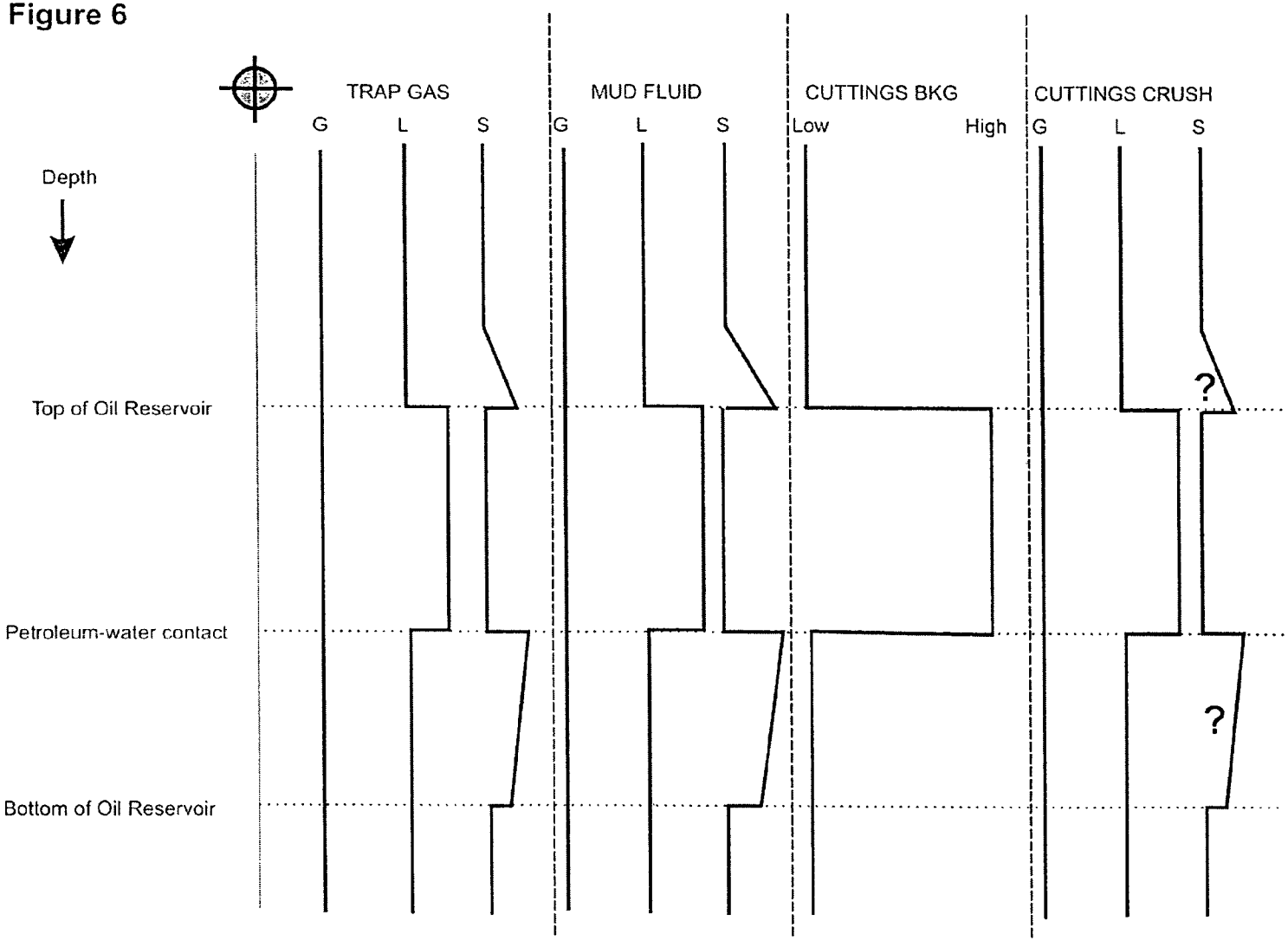
FIG. 6 shows the results of cuttings and borehole volatiles analysis during more-or-less neutral-balanced drilling conditions of the structure illustrated in FIG. 5.
Figure 7:
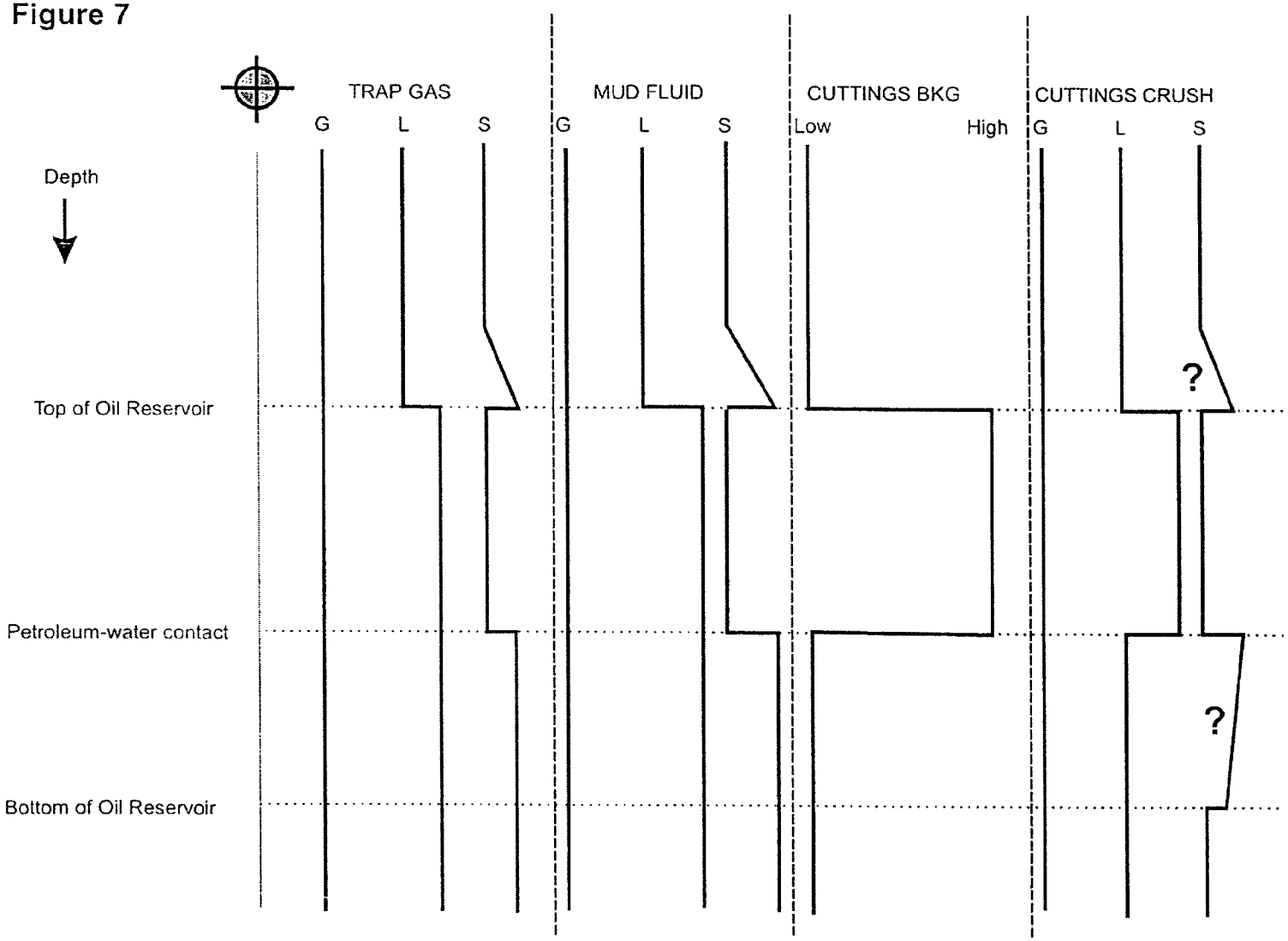
FIG. 7 shows the results of cuttings and borehole volatiles analysis during under-balanced drilling conditions of the structure illustrated in FIG. 5.
Figure 8:
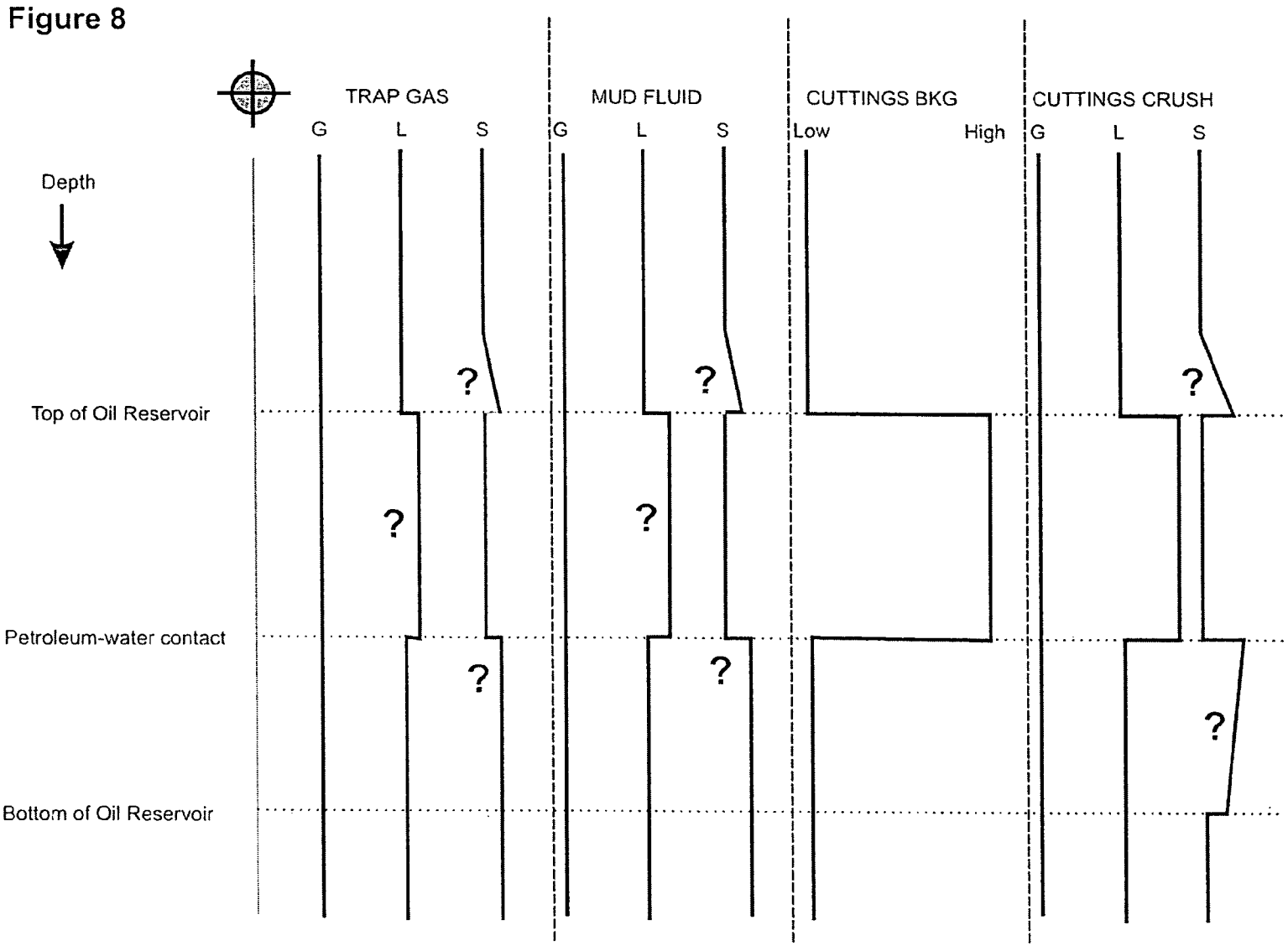
FIG. 8 shows the results of cuttings and borehole volatiles analysis under over-balanced drilling conditions of the structure illustrated in FIG. 5.

The results of borehole volatiles and cuttings volatiles analysis using the prescribed method and apparatus under these three different drilling scenarios is illustrated in FIGS. 6, 7 and 8. FIG. 6 illustrates the results of drilling the hydrocarbon-bearing formation shown in FIG. 5 under neutral-balanced conditions. Trap gas and mud volatiles analysis record the presence of oil and soluble species and identify the location of the oil-water contact. Cuttings background is high in the oil zone, reflecting adsorbed or loosely held petroleum species that become volatile under analytical conditions of the apparatus. These species are generally absent from geologic formations that do not currently contain some petroleum in pore space, but can be indicative of residual, immovable petroleum as opposed to producible petroleum. Distinction between these two possibilities relies on the results of borehole volatiles analysis, which would generally indicate low petroleum readings in a residual petroleum occurrence that is immovable, but would typically display significant petroleum responses in a producible petroleum reservoir. The cuttings crush data display features similar to the trap gas and mud volatiles in this case, although it need not be so. In particular, the S anomaly may or may not be present, and the L anomaly may record a thicker petroleum column in the past, if some of the original petroleum charge was lost to the reservoir as in FIGS. 1 and 13. Cumulatively the data indicate a present-day, moveable oil charge within the reservoir. The limits of the charge are defined, and the data suggest that there was not a more extensive column in the past. Current mudlogging practices, even under the best conditions, could only identify the top and base of the petroleum column by the increase and decrease in paraffins response, which might look substantially the same as the L indicator trace on the trap gas profile. Although the base of the liquid petroleum anomaly is identified, it cannot be determined from current mudlogging practices whether the base correlates with the base of the reservoir itself, or whether a fluid contact has been crossed. The distinction between these possibilities in real time is important to optimize completion strategies, and calculate reserves within the structure. It is conceded that the nature of the basal contact of the petroleum anomaly is potentially determinable via other techniques (e.g., electric log analysis; other geochemical analyses), but these are not available in real time. Additionally, depending on the drilling program and conditions under which these ancillary data are collected they may or may not be able to determine the required information.

FIG. 7 illustrates the results of drilling the hydrocarbon-bearing formation shown in FIG. 5 under under-balanced conditions. In this case, the top of the petroleum anomaly is defined by the trap gas and mud volatiles L traces, but the base of the anomaly is not identified on these traces, due to the continued ingress of formation fluid into the borehole from the pay zone, despite the deeper drilling. Under neutral-balance drilling, the signal at any depth is substantially reflective of the pore fluid in the rock being penetrated at that depth, because fluids from shallower formations that were previously penetrated are retained by the mud column, as well as the mudcake that typically builds up on the walls of the borehole over time. In the case of under-balanced drilling the mud weight and mudcake are insufficient to prevent continuous and protracted influx of significant amounts of fluid from the formation, so that the signal at any point has significant up-hole contributions. In the case of a penetrated petroleum zone with standard gas-detection equipment, the top of the zone will be identified by an increase in hydrocarbons, but there will typically not be any interpretable decrease in hydrocarbon response upon deeper drilling whether or not a fluid contact is penetrated. However, with the method and apparatus of the current invention, the contact is identified by an increase in S below the oil-water contact. Furthermore, the results of cuttings volatiles analysis, as they are independent of the balance of the mud system, display the same features as in FIG. 6, namely, they define the top and base of the petroleum column. The importance of the combined data set can be appreciated, as cuttings analysis alone may or may not identify the based of the anomaly as a current oil-water contact (as opposed to a paleo-oil-water contact with some residual immovable oil), and the borehole volatiles analysis is more confidently interpreted in light of independent evidence for extent of liquid petroleum charge identified in the cuttings data.

FIG. 8 illustrates the results of drilling the hydrocarbon-bearing formation shown in FIG. 5 under over-balanced conditions. Here, borehole volatiles responses may be substantially reduced as compared to neutral-balanced drilling, due to the propensity for the drilling fluid to invade the formation. In some cases, invasion can be so extensive that the near-borehole becomes thoroughly flushed, even ahead of the drill bit, and trap gas records little or no response in petroleum-bearing formations with standard gas-detection methodologies and apparatus. Many hydrocarbon reservoirs have been penetrated with these negative results, and, in some cases these formations were never tested after the wells were drilled, and were only discovered years later with subsequent wellbores. The method and apparatus outlined in the invention is a distinct improvement for two reasons. Firstly, even subtle increases in indicator compounds can be recorded and many of these compounds are not analyzed with current mudlogging equipment. These species may be more advantageously analyzed in the mud volatiles, as compared to the trap gas, because these trace species may not be transferred to the vapor phase in sufficient abundance to be analyzed. Secondly, as in the case of under-balanced drilling, cuttings volatiles chemistry is independent of the mud system weight and, thus, define the top and base of the petroleum column, albeit, may or may not identify them as a present-day column as in the previous example.

Determining the Sequence of Events in a Multiply Charged Reservoir

The present-day petroleum charge that is discovered within a petroleum reservoir is often the cumulative result of several charging events, and these events may involve fluids with substantially different properties, in particular, oil and gas. In general, oil precedes gas as the result of the natural evolution of a single source rock, because liquid petroleum generally forms a higher percentage of the early expulsed products from a mature source rock and gas forms a higher percentage of the late expulsed products from a mature source rock, providing the source rock is capable of generating both oil and gas. However, in certain cases, particularly where multiple source rocks are involved, or where a single source rock is present at different levels of maturity in the same location and contributes via multiple migration pathways to a given reservoir, gas can precede oil. This is the case, for instance, in several North Sea oil and gas fields. The distinction among possible filling episodes is important in understanding the petroleum system operating in an area, hence the plausible distribution of oil and gas in other structures nearby.

Figure 9:
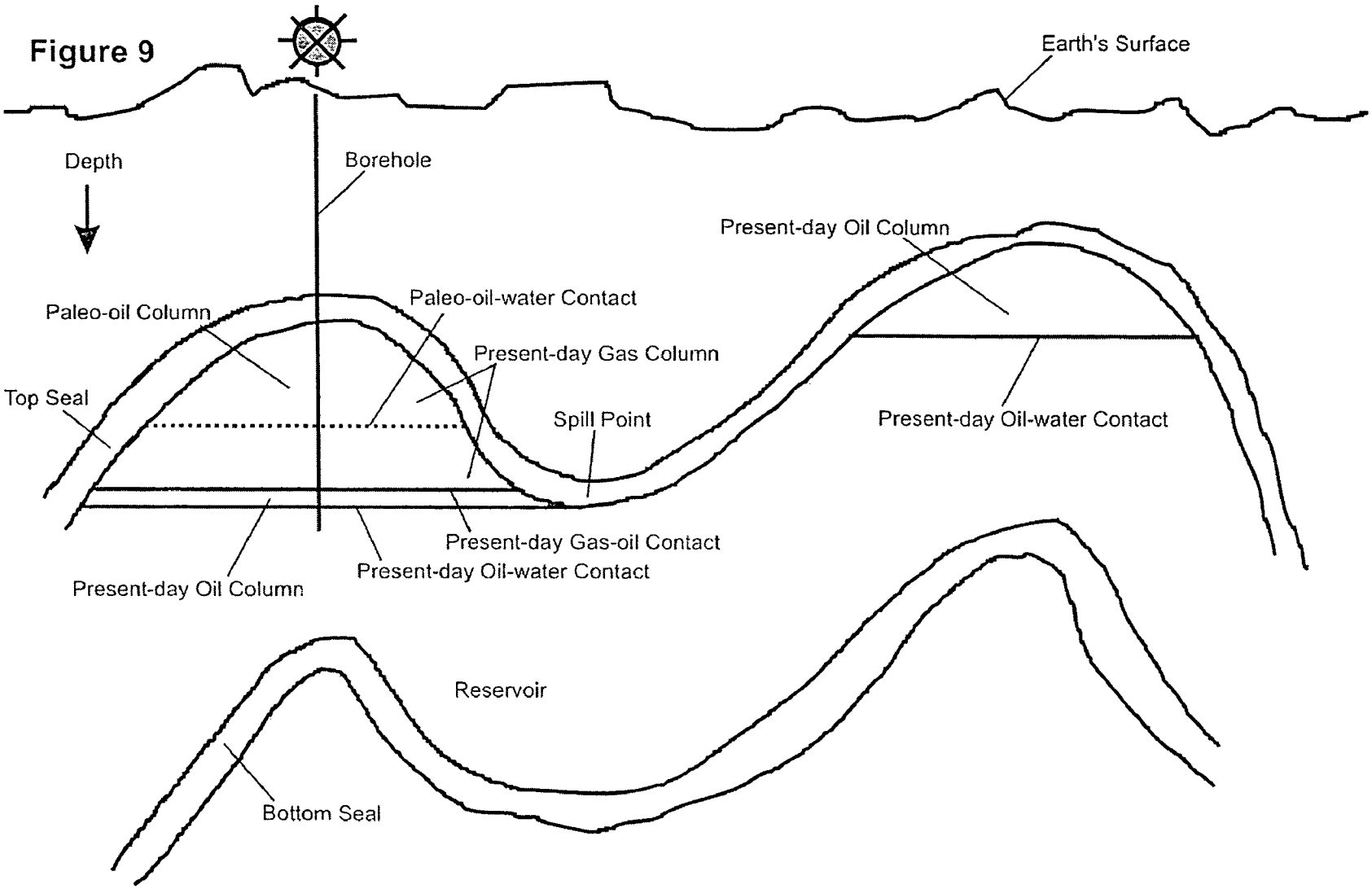
FIG. 9 illustrates a penetrated petroleum reservoir containing a gas leg, an oil leg a gas-oil contact and an oil-water contact. In this example oil arrived at the reservoir prior to gas, and the paleo-oil-water contact is identified. The subsequent gas charge spilled most of the oil to an adjacent updip structure.

FIG. 9 shows a petroleum reservoir penetrated by a borehole. In this case, a gas column, and a smaller oil column are present. The position of the gas-oil-contact and the oil-water-contact are shown. The reservoir is filled to the spill point and the updip structure contains additional oil. Oil preceded gas in this case and both oil and gas were generated from the same source rock, in the same generative kitchen and utilized the same migration pathway to the reservoir. The first charge established an oil column in the downdip structure, the limits of which are defined by the paleo-oil-water contact. The second charge provided gas to the structure, which, due to its buoyancy, displaced the oil to the lower limit of structure closure of the reservoir, the spill point, and caused a substantial portion of it to invade the updip reservoir. The volume of the gas charge was insufficient to completely displace the oil, hence, a thin oil column remains in the downdip structure.

Figure 10:
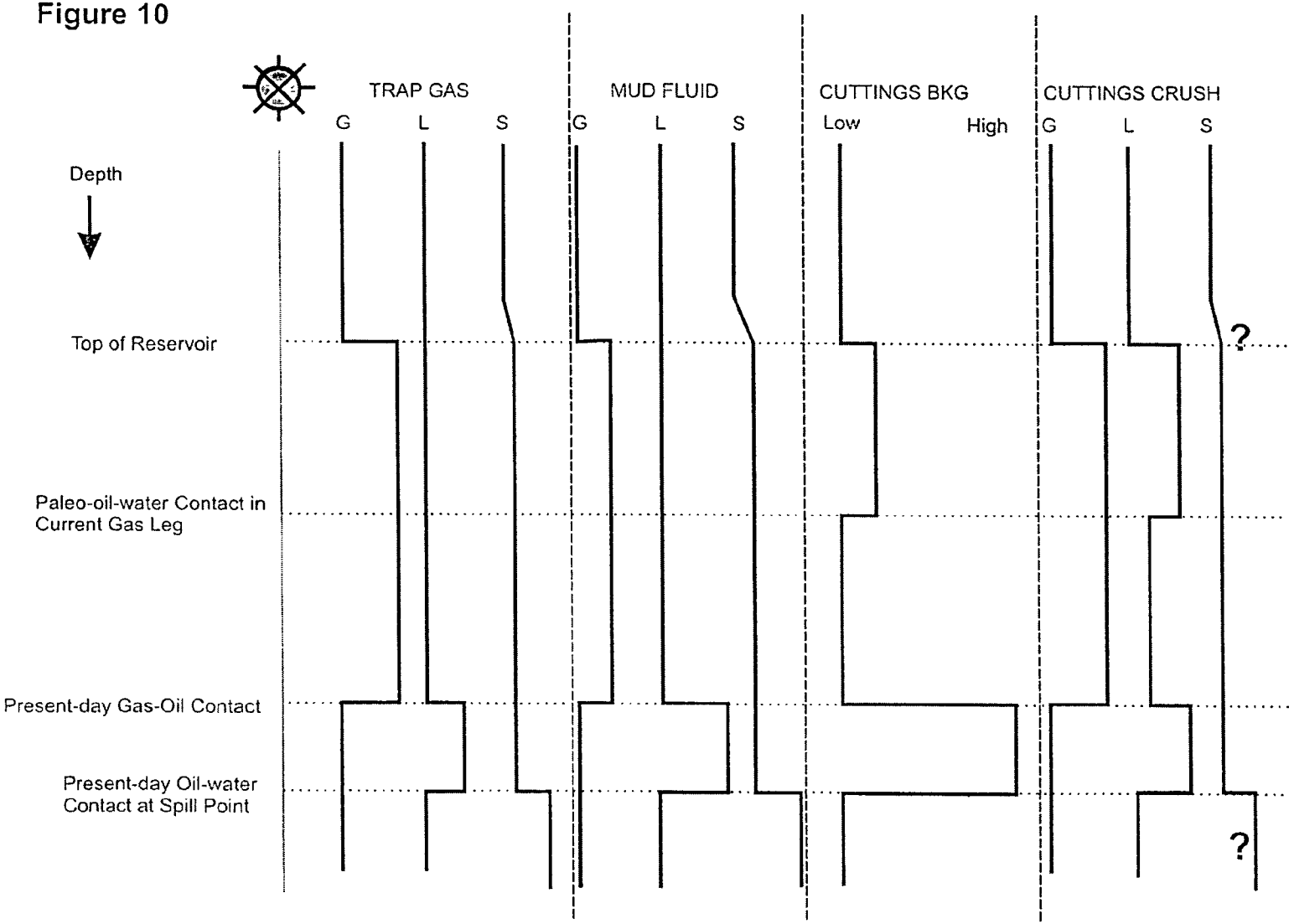
FIG. 10 shows the results of cuttings and borehole volatiles analysis obtained from the example structure illustrated in FIG. 9.

FIG. 10 illustrates the results of borehole volatiles and cuttings volatiles analysis of samples collected from the borehole illustrated in FIG. 9. G indications in the trap gas and mud volatiles ideally define the limits of the present day gas column (assuming neutral-balance drilling), while L indications in the same fluids define the limits of the present day oil column. S indications may increase somewhat in the gas and liquid petroleum column, due to fractionation of these species into bound water, but are particularly anomalous in the water leg, reflecting stripping of soluble species from the overlying oil charge, as well as diffusional migration of these same species from the oil accumulation in the updip structure. Cuttings background indicates an anomaly in the paleo-oil-column and a larger anomaly defining the present-day oil column. The relative and absolute strengths of these anomalies are a function of the lithologic characteristics (e.g., microporosity) as well as residence times and filling speeds. Fluids from the cuttings crush analysis define the present day gas column (G anomaly) as well as the present day and paleo-oil columns (L anomaly). S anomalies may or may not be present to define the water-leg and anticipate the oil leg within the gas leg. Again, the relative and absolute strengths of these anomalies are a function of residence times and filling speeds. The results of these data allow the filling history to be deduced, namely, an early oil charge followed by a later gas charge that displaced the early oil column. The volume of the paleo-oil-column can be calculated from information provided by the invention, and can be used to deduce the volume of spilled oil currently reservoired in the updip structure. This is accomplished by considering the volume of oil in the paleo-column, the volume of oil remaining in the downdip structure and the amount of oil that can dissolve into the volume of gas in the downdip structure. This is particularly useful if the structural reconstruction is incomplete so that the actual location of the spill point is not known. This information can be used to assess the economics of drilling the updip structure, since the likely volume of oil to be encountered is calculable. Additionally, the data can be used to infer that nearby downdip structures along the same migration route will be filled to their respective spill points with gas, and that oil will not be encountered. Thus, information on several nearby structures can be obtained from data collected on one borehole, allowing optimization of subsequent drilling programs at a substantial cost savings.

Distinguishing Among Charged and Barren Updip Reservoirs

Individual boreholes often penetrate several prospective reservoir units. Many of these potential reservoirs may not have the ability to trap petroleum at the borehole location, but may have stratigraphic or structural traps updip. An example of such a scenario is diagrammed in FIG. 11. A penetrated structure is found to be wet. Shallower in the section, above an erosional unconformity, four potential reservoirs have been penetrated. Reservoir A has an updip oil column. Reservoir B is barren updip, but contained an oil column in the past, which leaked to Reservoir A. Reservoir C has an updip gas column. Reservoir D is barren and never migrated hydrocarbons. Reservoir E never had a charge, and never migrated petroleum through it. Existing wellsite gas-detection technology has no ability to distinguish among these various reservoirs, in terms of their updip petroleum potential.

Figure 11:
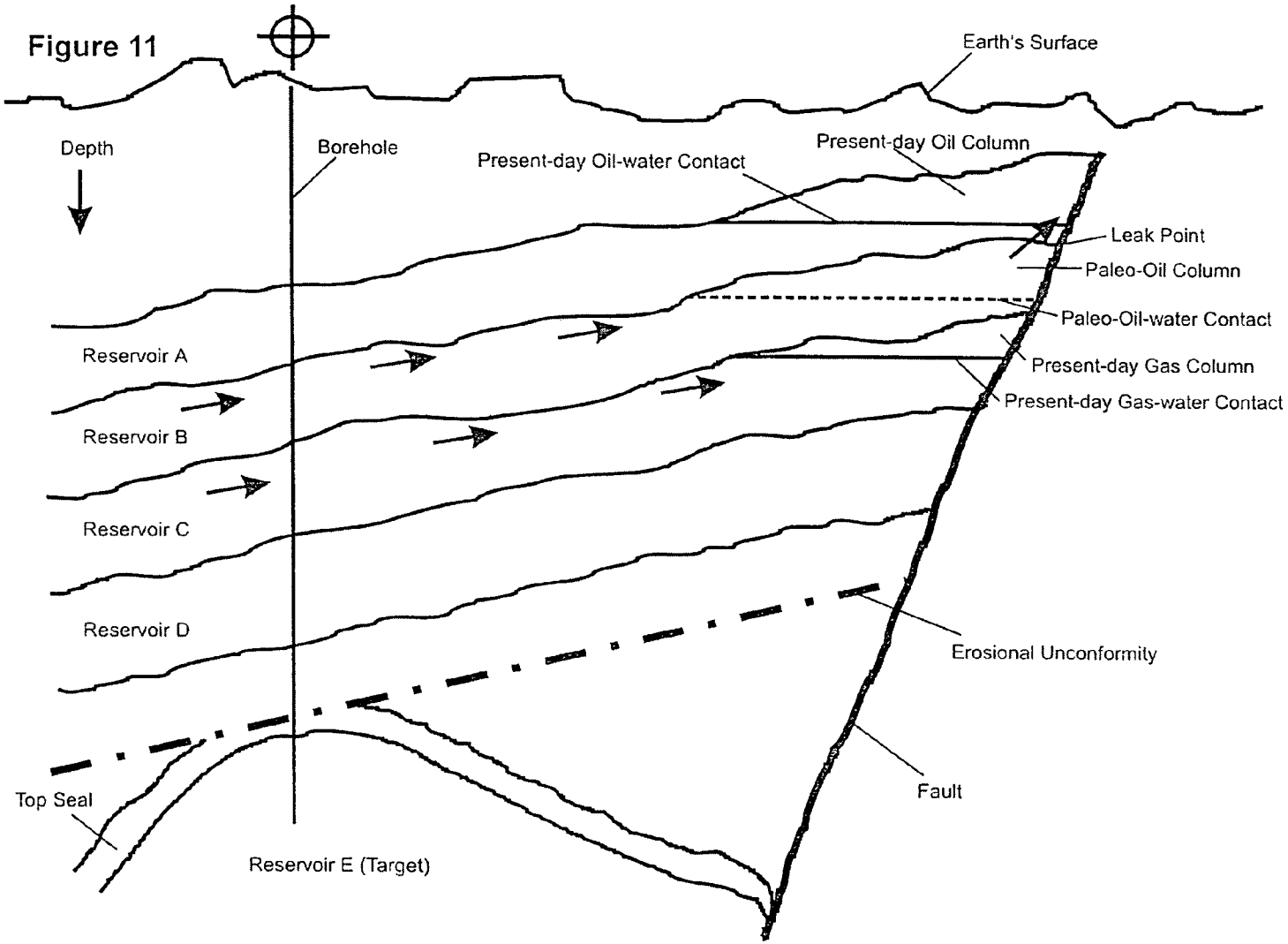
FIG. 11 illustrates a tilted sequence of subsurface formations floored by an erosional unconformity below which lies a wet target Reservoir E penetrated by a borehole. Reservoirs A, B, C and D are not within structural closure at the borehole site, but have updip potential for fault trapping. Oil migrated through reservoir B, accumulated against the fault and was subsequently spilled into reservoir A, where it now resides. Gas migrated through reservoir C and is reservoired updip. Hydrocarbons did not migrate through Reservoirs A, D or E.
Figure 12:
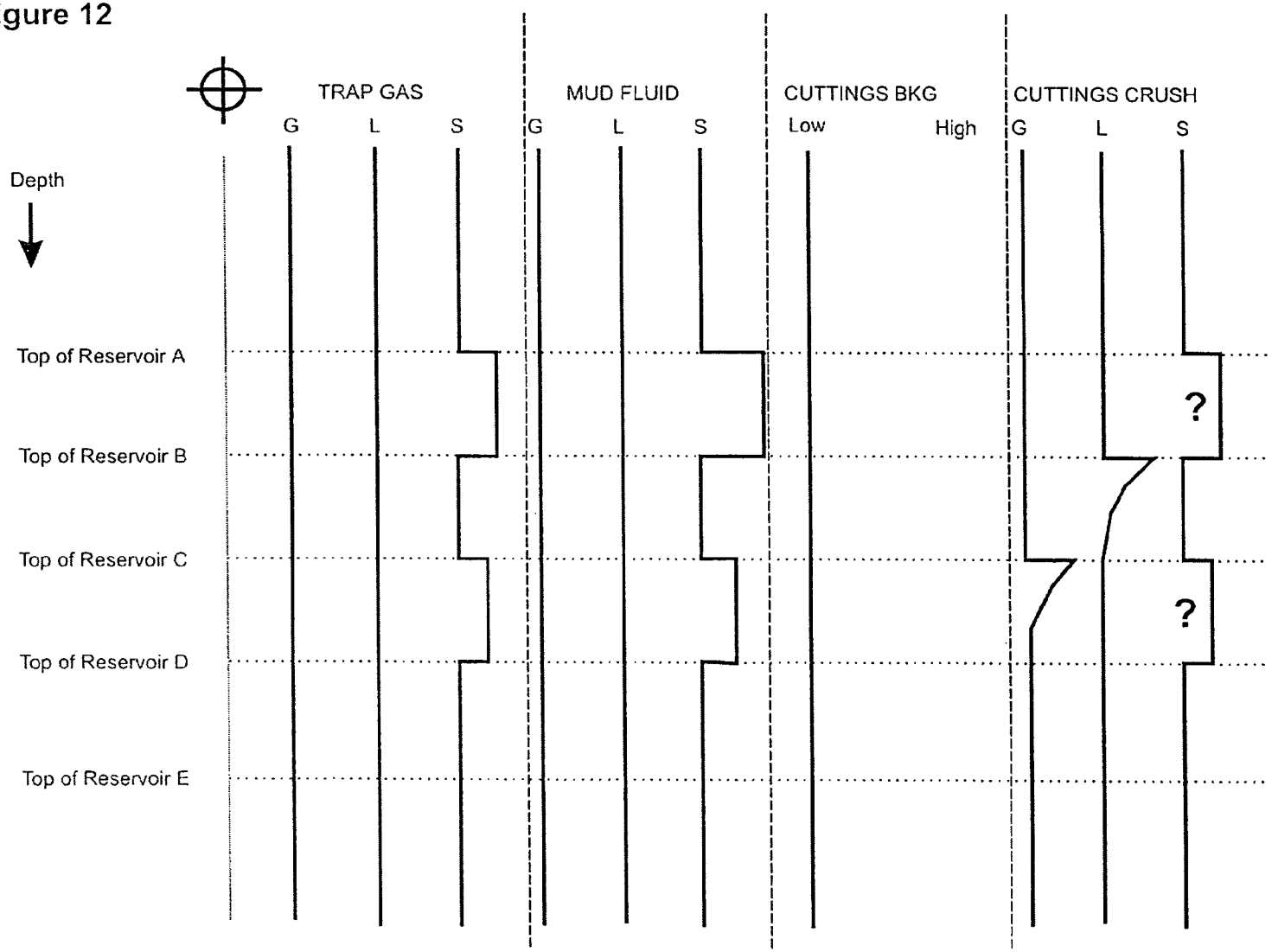
FIG. 12 shows the results of cuttings and borehole volatiles analysis obtained from the example structure illustrated in FIG. 11.

FIG. 12 illustrates the results of borehole volatiles and cuttings volatiles analysis of samples collected from the borehole illustrated in FIG. 11. S anomalies in trap gas and mud fluid suggests Reservoirs A and C to be charged updip, and, depending on the chemistry of the S anomaly, the interpretation of updip oil vs. updip gas can be made. No evidence of penetrated oil or gas accumulations is present in the borehole volatiles data. Cuttings background volatiles are low, reflecting a lack of charge or paleo-charge in the penetrated section. Cuttings crush data indicate that oil migrated through Reservoir B and that gas migrated through Reservoir C. Reservoirs A, D and the target Reservoir E are distinguished as having hosted no migrating petroleum and containing no paleo-accumulations at the penetrated depths. S anomalies may or may not be present in the cuttings crush data to indicate the presence of updip charge in Reservoirs A and C. These data cumulatively indicate that Reservoirs A and C are prospective updip for oil and gas, respectively. The data also suggest that Reservoir A received its charge from another sand, or from another direction as there is no evidence of migration through Reservoir A at the borehole location. Reservoir B is implicated as the contributing sand, based on evidence of migration but no updip charge.

From these data, an updip well would be suggested based on economics. If only oil can be commercially produced, then a well would be planned to penetrate only as deep as Reservoir A, as no deeper penetration would encounter economic petroleum. If both oil and gas are desirable, then a well would be planned to penetrate Reservoir C. There would be no need to drill deeper than Reservoir C in any case, as no petroleum would be encountered in this position.

Picking Test Points and Planning Well Completions

Figure 13:
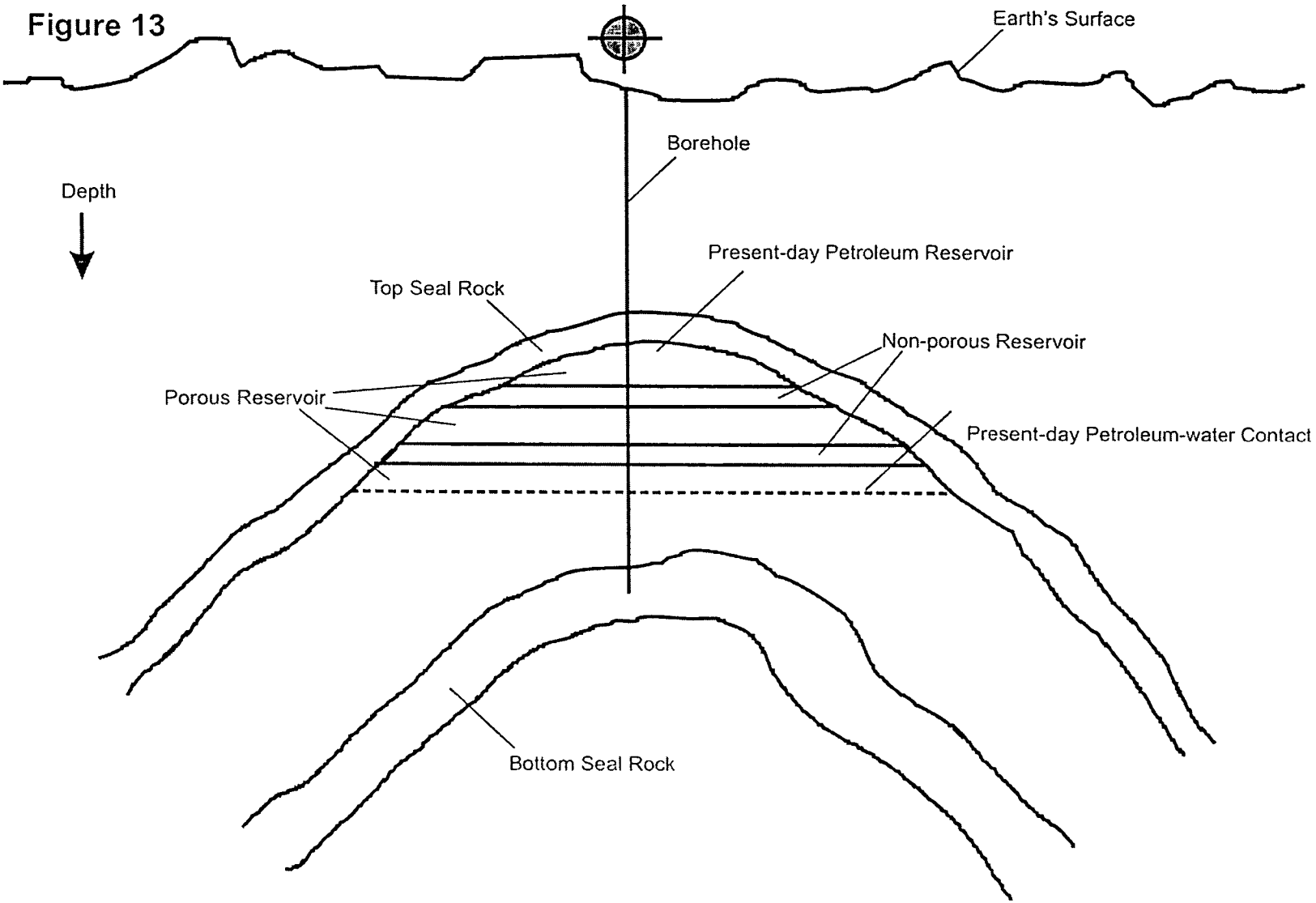
FIG. 13 illustrates a penetrated oil reservoir with many of the same features as discussed previously for FIG. 5. In this case, however, the reservoir does not have a homogeneous porosity distribution, but, rather, contains two relatively non-porous and less permeable layers.

FIG. 13 illustrates a penetrated oil reservoir with many of the same features as discussed previously for FIG. 5. In this case, however, the reservoir does not have a homogeneous porosity distribution, but, rather, contains two relatively non-porous and impermeable layers. Although these less porous intervals are not seals to hydrocarbons, because they have allowed the reservoir to fill above them, they may act as baffles to production and prevent oil below them from accessing higher perforation points. Similarly, completions or tests within the tight zones themselves may not produce oil at economic rates. Although electric loggings after the wellbore is completed have the potential to define the best reservoir sections, they are often equivocal, depending on lithologic and fluid details, because they are inferring reservoir quality indirectly. Direct measurements of porosity and permeability generally require collection of a core sample and shipping it to a laboratory for analysis. This process is costly and may take several days. Hence, defining reservoir quality and compartmentalization in reservoir units remains a critical issue and generally cannot be derived from wellsite analysis.

Figure 14:
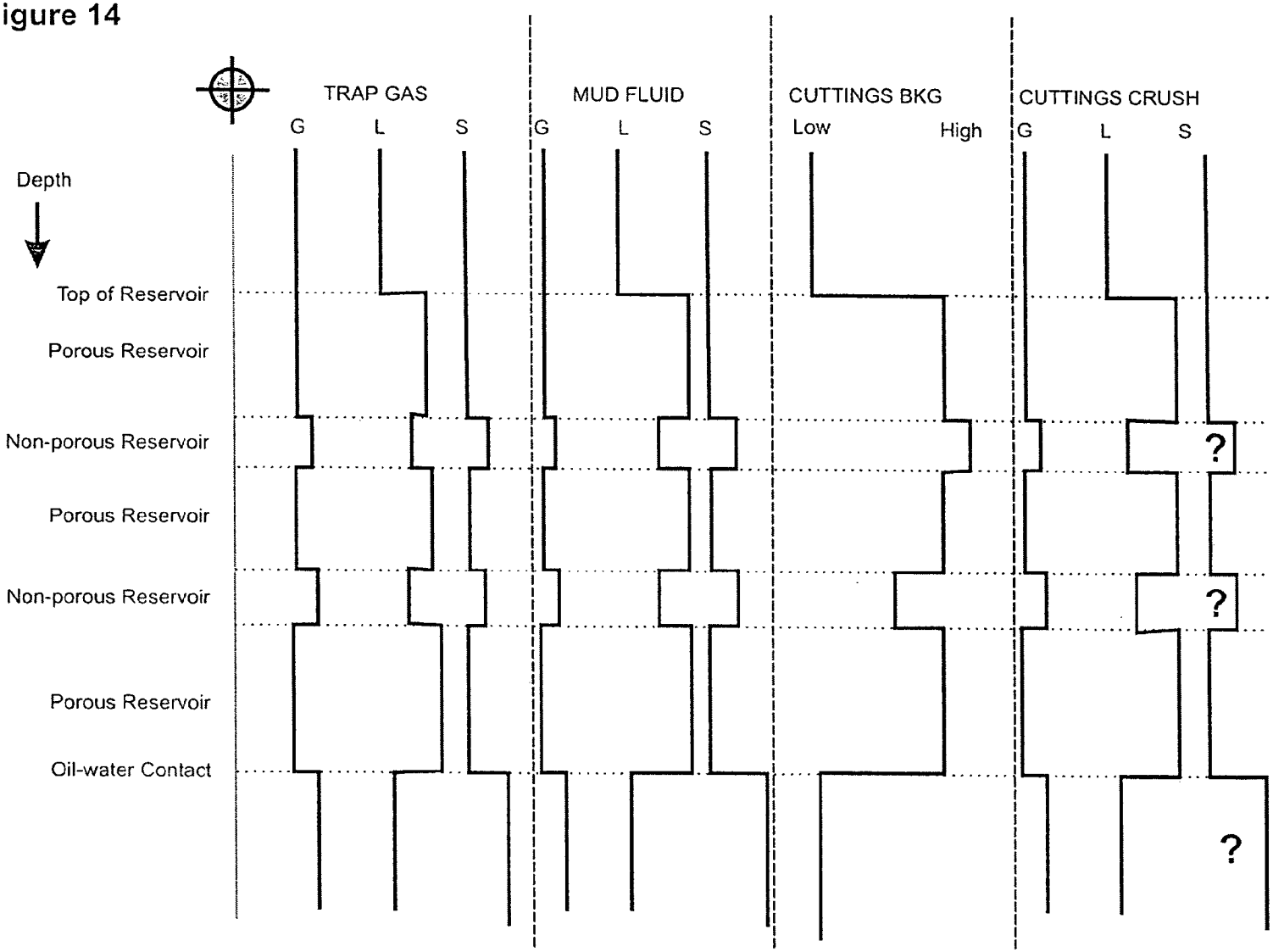
FIG. 14 shows the results of cuttings and borehole volatiles analysis obtained from the example structure illustrated in FIG. 13.

FIG. 14 shows the results of analysis of cuttings volatiles and borehole volatiles from the borehole in FIG. 13. Ideally trap gas, mud volatiles and cuttings crush analyses would show similar features. L indications are highest in the best reservoir sections, and are slightly less in zones of poorer reservoir quality. G and S indications may reflect higher water saturation in the poorer reservoir as well as potential for higher gas saturation in the tighter pore network represented by the less desirable reservoir. Cuttings background reflects the overall charge with possible breaks associated with the poorer reservoir. These breaks may be to higher or lower values, depending on the details of the system. A very tight reservoir with high capillary entry pressure may display lower overall background, while a microporous, but impermeable reservoir section may display higher overall background, due to abundant hydrocarbons in microporosity that are not easily extracted under ambient conditions. In some instances, inorganic species may be associated with more porous intervals. Helium, in particular, has been found to reflect porosity in some areas. Overall, these data would identify and allow testing and producing of the most porous reservoir sections, even in the absence of unequivocal electric logs or core, and would prevent leaving significant producible petroleum in the reservoir because a permeable portion of the reservoir between two baffles was not perforated.

Distinguishing Gas Show Sources and Recommending Testing

Figure 15:
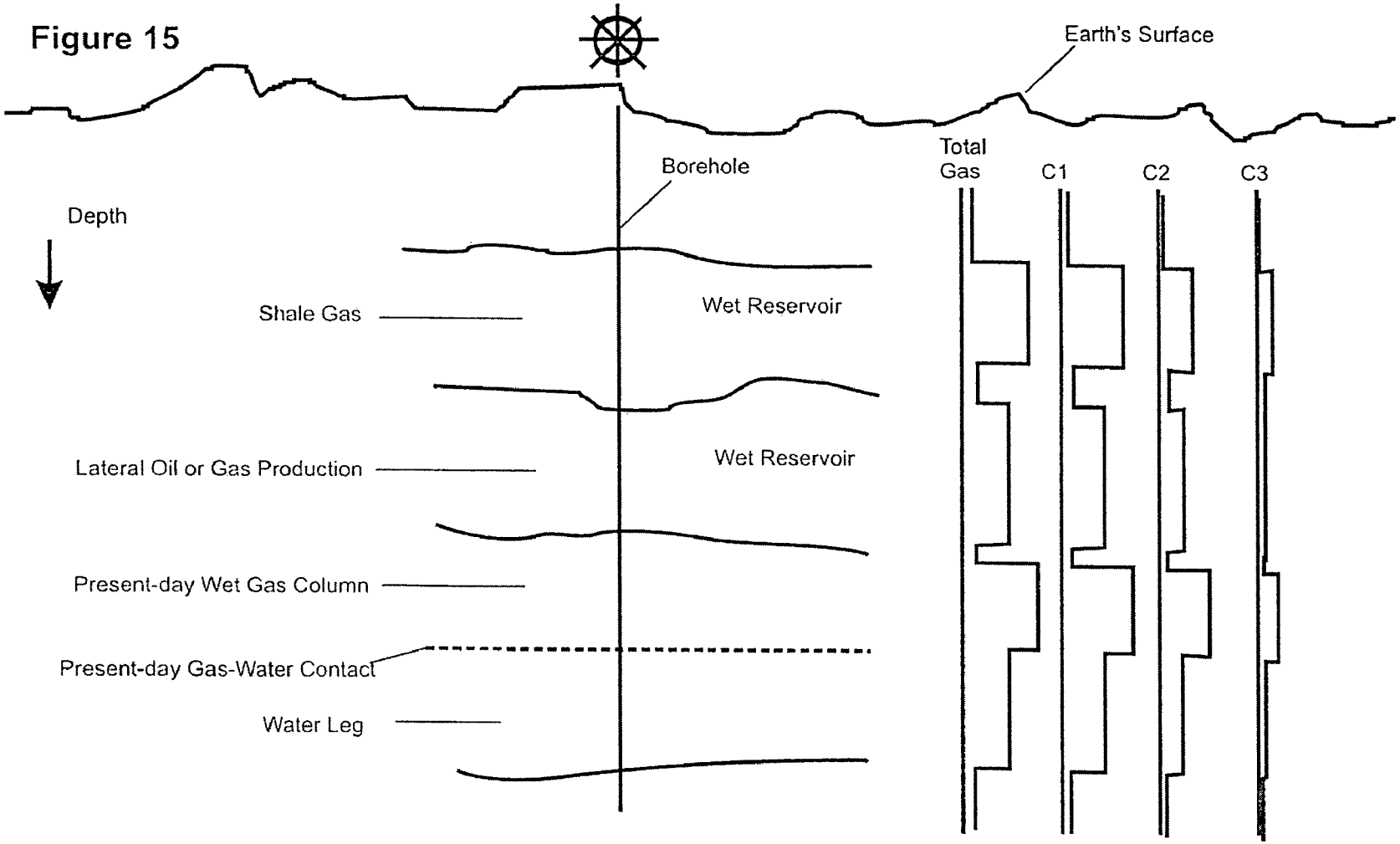
FIG. 15 illustrates three gas shows in borehole, one derived from intercalated shale, a second from a wet reservoir that is regionally productive, and a third from a gas accumulation. Also shown is the schematic but typical output from current wellsite gas detection equipment. Total gas is recorded from a hot-wire detector, while C1, C2 and C3 responses are output from a gas chromatograph.

Gas shows are commonly equivocal with current gas detection equipment. Frequently, the ultimate source or significance of the show is not fully realized until electric logs are run, if at all. This is a result of the limited number and type of organic compounds that are currently analyzed with typical hot-wire and GC arrangements. FIG. 15 shows a typical scenario. Three gas shows are detected; all give readings on the hot wire detector and GC, with the only significant differences among the anomalies being in signal strength and, perhaps, wetness (e.g., variable C3). These three shows are in fact from three different sources, two of which are of exploration significance, but only one of which warrants testing. The shallowest anomaly consists of shale gas that is evolved during drilling of kerogen-rich shales. The gas may represent locally generated petroleum or may be produced during drilling by heat at the drill bit. These shales are typically not the source of the petroleum that is being sought in the area, hence may be chemically distinct. In particular inorganic species, such as carbon dioxide may be enriched in shale gas shows. The intermediate depth anomaly consists of water-soluble gases within an aqueous pore fluid that is in communication with a nearby petroleum accumulation. This anomaly also contains other water-soluble hydrocarbon species, including benzene and organic acids. The deepest gas show is associated with a gas column.

Figure 16:
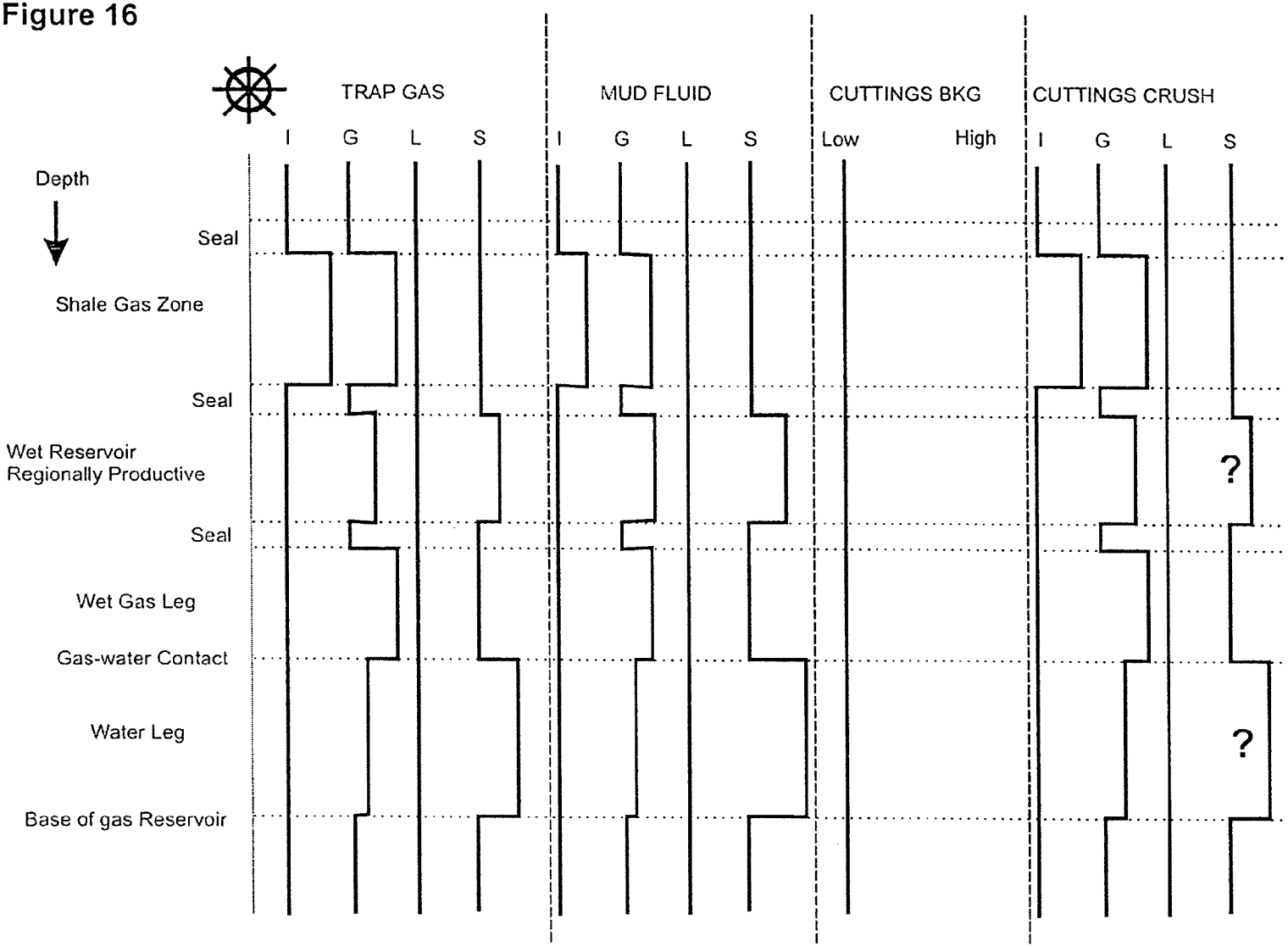
FIG. 16 shows the results of cuttings and borehole volatiles analysis obtained from the example structure illustrated in FIG. 15. Note that an additional indicator has been added relative to previous Figures, namely I. I represents diagnostic inorganic species, such as $CO_2$, He or $H_2S$.

The results of borehole and cuttings volatiles analysis are shown in FIG. 16. The shale gas is distinguished by its inorganic signature I, while the wet reservoir with dissolved gas is identified by associated water-soluble species not analyzed with the hot-wire-GC combination. Ratios of paraffins to naphthenes or paraffins to aromatics may be low in this zone, due to the relative insolubility of paraffins. The gas column and gas-water contact is evident in the deepest show. The results of this analysis suggest that a test should be performed only on the deepest show. Additionally, the data suggest that the intermediate-depth reservoir is charged nearby, and the location of this accumulation should be sought. Other inorganic species may be associated with different show types. For instance, helium has been found to be associated with gas shows in some areas, and specific sulfur compounds have been identified in other regions. Once the diagnostic fingerprint is found, shows in subsequent wells in the area can be confidently interpreted under the present invention.

Distinguishing Between Thermogenic and Biogenic Dry Gas

While thermogenic gas is the result of thermal maturation of source rock, biogenic gas results from bacterial activity in the subsurface. All other things being equal, bacteria can remain active to maximum temperatures of about 65° C. Depending on the geothermal gradient in the area, this temperature can be reached at very shallow depth, or quite deep (e.g., 10,000 or more feet below the earth's surface). Bacterial gas is generally quite dry, being dominated by methane with little or no ethane and propane. However, thermogenic gases can have substantially similar chemistry, in terms of paraffin distribution. The distinction between thermogenic and biogenic gas is generally made on the basis of carbon and hydrogen isotopic analysis; however, this generally requires careful sampling of gas from the well at specific intervals and sending the samples away for laboratory analysis—a costly and untimely process.

The inability to distinguish between thermogenic and biogenic gas with current wellsite gas detection technology results from the limited range of compounds that are analyzed. Methods and apparatus covered in the present invention have shown that a specific set of inorganic compounds and non-paraffin organic species tend to be associated with biogenic gas, particularly when that gas has been generated by the process of bacterial sulfate reduction (BSR). These species are not present in purely thermogenic gases. The key indicator species are shown in Table 1 and include $CO_2$, $H_2S$, COS, CS2 and the S2 fragment from native sulfur. Mixed thermogenic and biogenic gases tend to contain the previously mentioned species as well as paraffin-dominated gas-range hydrocarbon species (largely methane, ethane, propane, butane and pentane), and, possibly, thiols and simple aromatics such as benzene and toluene. In this case, the bacteria use the light hydrocarbons and dissolved sulfate to fuel life processes, producing the array of key indicator species as byproducts or through concentration. Thermogenic gases tend not to contain BSR indicator species, rather, are dominated by low molecular weight paraffins. Even dry thermogenic gases tend to have trace amounts of C2-C4 hydrocarbons that can be detected with MS. High maturity, thermogenic gases in some areas may contain significant $CO_2$ and noble gases (notably He). He, in particular, is not associated with biogenic gas.

Figure 17:
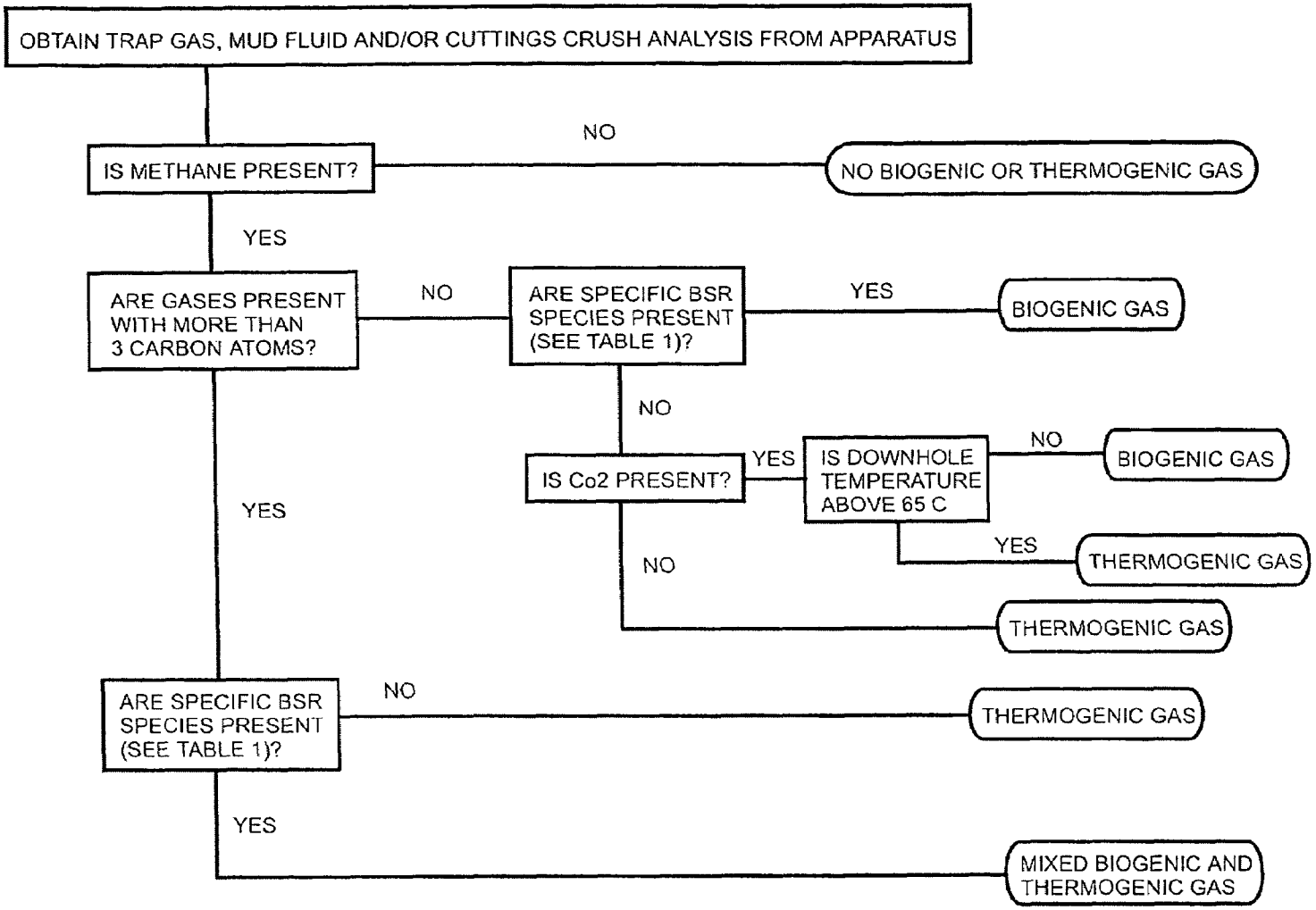
FIG. 17 is a flow diagram illustrating a method of distinguishing between biogenic, mixed biogenic/thermogenic and thermogenic gas, using output from the apparatus.

FIG. 17 illustrates the method for distinguishing among biogenic, thermogenic and mixed biogenic/thermogenic gases using output from the apparatus. The method is applicable to trap gas, mud volatiles or cuttings crush analysis, although the preferred embodiment favors using two or more of the three analytical functions. The results of the cuttings crush may represent a paleo-system rather than a present-day system.

The first step in the method is to verify the presence of methane. If no methane is present, then no biogenic or thermogenic gas is present. If methane is present, the next step is to assess the maximum carbon number recorded by the apparatus. If it is greater than 3 some component of thermogenic gas is indicated. If no BSR species are present, then purely thermogenic gas is indicated. If BSR species are present, then a mixed biogenic and thermogenic gas is indicated and it is likely that biogenic gas resulted from alteration of the thermogenic component. If, on the other hand, the maximum carbon number is less than or equal to 3, then the next step is to assess if BSR species are present. If so, then biogenic gas is indicated. If BSR species are not present, the presence of $CO_2$ is assessed. If $CO_2$ is not present then thermogenic gas is indicated. If $CO_2$ is present, then the downhole temperature is evaluated at the point the sample is taken. Mud temperature information is generally continually monitored while drilling and can be converted to downhole temperature with appropriate corrections made by anyone skilled in the art of mudlogging.

If the downhole temperature is found to be in excess of 65° C., then thermogenic gas is indicated, and this gas may be of high maturity. The presence of other inorganic species, such as helium, strengthens the conclusion. If the temperature is found to be below 65° C., then biogenic gas is indicated.

Inferring the Presence of Deep Petroleum Accumulations From Shallow Boreholes Low molecular weight hydrocarbon species undergo near-vertical microseepage from deep hydrocarbon sources. Although the details of the phenomenon are debated in the literature, it is thought that predominantly gas-range compounds are able to move past seals either continuously or episodically and eventually reach the earth's surface. This effect produces near-surface geochemical anomalies that can be evaluated by surface geochemical techniques involving soil samples in onshore areas or drop cores in offshore areas. These techniques seek to define the limits of these anomalies and infer the presence or absence of subsurface petroleum-bearing structures. Surface geochemical techniques, although effective, may be hindered by transient, near-surface processes.

Vertical microseepage of light hydrocarbon species is documented in the data produced by the apparatus of the present invention as well. The previous example is shown in diagrammatic form in FIG. 17 illustrating how data from the apparatus can be used to distinguish among biogenic, thermogenic and mixed thermogenic/biogenic gas shows. The mixed thermogenic/biogenic gas generally results from the vertical microseepage effect, followed by bacterial sulfate reduction at temperatures below 65° C. Anomalies typically display an abrupt floor defined by the disappearance of critical BSR species, and this tends to reflect the maximum temperature at which the bacteria are active. Thermogenic gas shows may exist below this floor, representing vertically seeping hydrocarbon species that have not been acted upon by bacteria. When microseeps are identified in shallow borings using the method and apparatus covered in the current invention, the presence of deeper liquid petroleum accumulations (oil or condensate) can be anticipated with much less risk than if a similar shallow boring does not contain evidence of microseepage. This would be useful, for instance, if the original bore is lost due to mechanical problems, if drilling conditions become intolerable to the point that the operating company is considering abandoning the hole, or if the original hole may be extended to test deeper reservoirs. If no seep has been found in the shallow portion of the borehole, then deeper drilling is statistically not favored. If a shallow seep is identified, there is a much greater probability of encountering deeper hydrocarbons.

Identifying Biodegraded Oil

One measure of petroleum quality, particularly of oil, is the extent of biodegradation. Bacterial alteration of liquid petroleum is generally economically unfavorable, and often results in heavy oil that is more difficult to produce and has less desirous refining characteristics. Hence, real-time distinction between biodegraded and non-degraded oil is important. If oil is degraded, there may be no need to incur the additional expense of testing the formation, if analysis suggests that the accumulation is probably uneconomic.

Biodegraded oil has a distinctive chemical signature on the apparatus. In addition to indications of liquid petroleum, bacterial-derived or concentrated species are generally present (see Table 1). Also, as bacteria generally favor paraffinic hydrocarbons as compared to naphthenic or aromatic species, these species will be preferentially removed. Hence, the ratio of paraffins to naphthenes or paraffins to aromatics will typically decrease in bacterially altered petroleum zones. Typical crude oils tend to have paraffin-to-naphthene ratios (expressed as P/(P+N)) above 0.5. Biodegraded petroleum tends to display values below 0.5. Extremely degraded oils may have values below 0.2. The method is applicable to trap gas, mud volatiles or cuttings crush analysis, although the preferred embodiment favors using two or more of the three analytical functions. The results of the cuttings crush may represent a paleo-system rather than a present-day system.

Monitoring Hydrogen Sulfide Concentrations

The presence of $H_2S$ is a health hazard and severely reduces the value of recovered oil or gas. In areas where $H_2S$ is expected, mudlogging procedures often involve adding $H_2S$ sequestering agents to the mud system to prevent dangerous release of $H_2S$ at the surface. Even so, $H_2S$ needs to be monitored with gas-sensors. Potential hazards occur if an unexpected release of $H_2S$ occurs in a borehole where $H_2S$ protocol is not in place. It is generally impossible to assess $H_2S$ concentration in a penetrated sour petroleum accumulation when sequestering agents are used. Hence, expensive tests must be undertaken to evaluate the quality of the petroleum phase.

The apparatus of the invention detects $H_2S$ and other related species that result from bacterial sulfate reduction at low temperature or thermochemical sulfate reduction at high temperature. Hence, it may be unnecessary to have additional, more expensive monitoring devices on site. Furthermore, because the fluids trapped in the cuttings are not contaminated by the mud system, are not in contact with sequestering agents and are not fractionated during sampling, cuttings crush analysis provides a means of monitoring relative $H_2S$ concentrations associated with hydrocarbon shows in cases where scavenging has eliminated $H_2S$ from the trap gas. If cuttings volatiles data suggest that the penetrated petroleum phase is too sour to be economic, then an expensive test may not be warranted. If, on the other hand, the petroleum appears sweet, then a test is less risky.

MCR 64 (interpreted to represent a fragment from volatilized native sulfur) has been found by the apparatus to be anomalous within water legs to overlying sour petroleum accumulations, or within wet reservoirs that are plumbed to a source of sour gas at depth. $H_2S$ may be fractionated into the aqueous phase as well. Using this observation, gas-water contacts or oil-water contacts may be recognized by an increase in MCR 64 and/or MCR 34 as the contact is crossed. Additionally, if MCR 64 in particular, is present in anomalous concentration throughout a prospective reservoir, that reservoir section may be interpreted to be water bearing, even if it is associated with gas shows on standard wellsite gas detection equipment. Testing of this interval would not be recommended.

Identifying Original Oil-Water Contactfor Enhanced Oil Recovery

Enhanced oil recovery operations generally benefit from knowledge of the original distribution of petroleum in a mature reservoir prior to significant depletion from production. In many cases, however, this information is unavailable because the reservoir was incrementally deepened over time or the necessary logs were not run. Cuttings crush data can reveal the original contact in both new infield wells as well as in archived samples from old wells, because the trapped fluids represent conditions operative prior to production of the field. This information will allow better planning of EOR operations.

$CO_2$ Flood Breakthrough Detection

One method of Enhanced Oil Recovery involves flooding a mature field with $CO_2$, which solublizes some of the remaining non-producible oil allowing it to be recovered. One potential problem in such operations occurs if the $CO_2$ invades an undesired, more permeable portion of the system. In doing so, the flood will cease to contact the most economic portions of the reservoir and recovery will suffer. These thief zones can be detected with the apparatus as future infill wells are drilled into the field, or by establishing monitor wells throughout the area. Helium can be used as well, because it generally forms a significant trace gas in the $CO_2$.

Whereas, the present invention has been described in relation to the drawings attached hereto, it should be understood that other and further modifications, apart from those shown or suggested herein, may be made within the spirit and scope of this invention.

TABLE 1

Some Suggested MCR and MCR ratios For Interpretation of Data Derived from Method and Apparatus of the Invention

| Element or Compound | Diagnostic MCR | Value |
|---|---|---|
| Natural Gas Indications | | |
| Methane | 15 | high |
| Methane/Ethane | 15/30 | high |
| Methane/C4 Paraffin | 15/57 | high |
| Methane/C7 Alkylated Naphthene | 15/97 | high |
| (Sum C1-C4)/(Sum C5-C10) | — | high |
| Liquid Petroleum Indications (Oil or Condensate) | | |
| C7 Alkylated Naphthene | 97 | high |
| Methane/Ethane | 15/30 | low |

TABLE 1-continued

Some Suggested MCR and MCR ratios For Interpretation of Data Derived from Method and Apparatus of the Invention

| Element or Compound | Diagnostic MCR | Value |
|---|---|---|
| Methane/C4 Paraffin | 15/57 | low |
| Methane/C7 Alkylated Naphthene | 15/97 | low |
| (Sum C1-C4)/(Sum C5-C10) | | low |
| Proximal Pay Indicators | | |
| Benzene | 78 | high |
| Toluene | 91 | high |
| Xylene | 105 | high |
| Acetic Acid | 60 | high |
| Acetic Acid/C4 Paraffin | 60/57 | high |
| Benzene/C4 Paraffin | 78/57 | high |
| Benzene/Toluene | 78/91 | high |
| C4 Paraffin/C4 Naphthene | 57/55 | low |
| C6 Paraffin/C6 Aromatic | 71/77 | low |
| Indicators of Bacterial Activity or Microseepage | | |
| Methane | 15 | high |
| Ethane | 30 | high |
| Carbon Dioxide | 44 | high |
| Hydrogen Sulfide | 34 | high |
| Carbonyl Sulfide | 60 | high |
| Acetic Acid | 60 | high |
| Native Sulfur Fragment | 64 | high |
| Carbon Disulfide | 76 | high |
| Benzene | 78 | high |
| Toluene | 91 | high |
| C4 Paraffin/C4 Naphthene | 57/55 | low |
| Inorganic Species of Interest | | |
| Hydrogen | 2 | high |
| Helium | 4 | high |
| Water | 18 | high |
| Nitrogen | 28 | high |
| Argon | 40 | high |
| Carbon Dioxide | 44 | high |
| Hydrogen Sulfide | 34 | high |

What is claimed is:

1. An apparatus to analyze fluids from boreholes, which comprises:

a mass spectrometer analyzer in fluid communication with a circulating mud system, wherein said mass spectrometer analyzer subjects fluid samples from said mud system to mass spectrometry to determine mass to charge ratios data for multiple chemical species;

a pumping system to produce a vacuum wherein force of said vacuum moves said fluid samples from said circulating mud system to said mass spectrometer analyzer; and a controller to monitor output from said spectrometer analyzer wherein said mass spectrometer, said pumping system, and said controller are all integrated into a single, portable apparatus.

2. An apparatus as set forth in claim 1 wherein said mass to charge ratios data is analyzed in relation to depth or time to produce multiple chemical species indicators.

* * * * *